US006674238B2

(12) United States Patent
Otani et al.

(10) Patent No.: US 6,674,238 B2
(45) Date of Patent: Jan. 6, 2004

(54) PLASMA DISPLAY PANEL

(75) Inventors: Eishiro Otani, Yamanashi-ken (JP); Hitoshi Taniguchi, Yamanashi-ken (JP); Chiharu Koshio, Yamanashi-ken (JP); Yoichi Sato, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 0 days.

(21) Appl. No.: 10/183,409

(22) Filed: Jun. 28, 2002

(65) Prior Publication Data

US 2003/0011307 A1 Jan. 16, 2003

(30) Foreign Application Priority Data

Jul. 13, 2001 (JP) ..... 2001-213846
Jul. 18, 2001 (JP) ..... 2001-218297
Jan. 22, 2002 (JP) ..... 2002-013320

(51) Int. Cl.[7] ..... H01J 17/49
(52) U.S. Cl. ..... 313/587; 313/582; 313/292
(58) Field of Search ..... 313/582, 583, 313/584, 585, 586, 587, 292; 345/60

(56) References Cited

U.S. PATENT DOCUMENTS 6,492,770 B2 * 12/2002 Amemiya et al. ..... 313/586
6,512,330 B2 * 1/2003 Nakajima et al. ..... 313/586
2003/0090443 A1 * 5/2003 Kobayashi ..... 345/60
2003/0127981 A1 * 7/2003 Otani et al. ..... 313/582

* cited by examiner

*Primary Examiner*—Edward J. Glick
*Assistant Examiner*—Elizabeth Gemmell
(74) *Attorney, Agent, or Firm*—Arent Fox Kintner Plotkin & Kahn, PLLC

(57) ABSTRACT

In a plasma display panel, a partition wall 15 surrounds each of discharge cells to define the discharge cells. Each of the discharge cells is divided by a second transverse wall 15B into a display discharge cell C1 which is opposite transparent electrodes Xa, Ya of paired row electrodes X, Y to provide for a sustaining discharge; and an addressing discharge cell C2 which is opposite a bus electrode Yb of the row electrode Y to provide for an addressing discharge caused between the bus electrode Yb and a column electrode D. A clearance r is provided between the discharge cell C1 and the addressing discharge cell C2 for communication between the cells C1 and C2.

37 Claims, 27 Drawing Sheets

SECTION V1—V1

TOTAL PRESSURE-DISCHARGE VOLTAGE

SECTION V2—V2

SECTION V3—V3

SECTION W3—W3

SECTION V5—V5

PRIOT ART

SECTION V—V

PRIOT ART

SECTION W—W

PLASMA DISPLAY PANEL

BACKGROUND OF THE INVENTION

1. Field of the Invention

The invention relates to a panel structure of a surface-discharge-scheme alternating-current-type plasma display panel.

The present application claims priority from Japanese Applications No. 2001-213846, No. 2001-218297 and No. 2002-13320, the disclosures of which are incorporated herein by reference for all purposes.

2. Description of the Related Art

In recent times, a surface-discharge-scheme alternating-current-type plasma display panel has been received attention as a slim, large sized color screen display, and has become commonly used in ordinary households and the like.

FIG. 34 to FIG. 36 are schematic views of a conventional structure of the surface discharge-scheme alternating current-type plasma display panel. FIG. 34 is a front view of the conventional surface-discharge-scheme alternating-current-type plasma display panel. FIG. 35 is a sectional view taken along the V—V line of FIG. 34. FIG. 36 is a sectional view taken along the W—W line of FIG. 34.

In FIGS. 34 to 36, the plasma display panel (hereinafter referred to as "PDP") includes a front glass substrate 1, serving as the display surface of the PDP, having on its back surface, in order, a plurality of row electrode pairs (X', Y'), a dielectric layer 2 covering the row electrode pairs (X', Y'), and a protective layer 3 made of MgO and covering the back surfaces of the dielectric layer 2.

The row electrode X' and the row electrode Y' of each row electrode pair (X', Y') are respectively constructed of transparent electrodes Xa', Ya' each of which is formed of a transparent conductive film of a larger width made of ITO or the like, and bus electrodes Xb', Yb' each of which is formed of a metal film of a smaller width assisting the electrical conductivity of the corresponding transparent electrode.

The row electrodes X' and Y' are arranged in alternate positions in the column direction, and the electrodes X' and Y' of each pair (X', Y') face each other with a discharge gap g' between. Each of the row electrode pairs (X', Y') forms a display line (row) L in the matrix display.

The front glass substrate 1 is situated opposite a back glass substrate 4 with a discharge space S', filled with a discharge gas, interposed between the substrates 1 and 4. The back glass substrate 4 is provided thereon with: a plurality of column electrodes D' which are arranged parallel to each other and each extend in a direction at right angles to the row electrode pair (X, Y); band-shaped partition walls 5 each extending in parallel to and between the two column electrodes D'; and phosphor layers 6 formed of phosphor materials of a red color (R), green color (G), and blue color (B), each of which covers the side faces of adjacent partition walls 5 and the column electrode D'.

In each display line L, the partition walls 5 partition the discharge space S' into areas each corresponding to an intersection of the column electrode D' and the row electrode pair (X', Y'), to define discharge cells C' which are unit light-emitting areas.

Such surface-discharge-scheme alternating-current-type PDP generates images through the following procedure.

First, in an addressing period following a reset period for carrying out reset discharge, discharge is selectively caused between one of the row electrode pair (X', Y') (the row electrode Y' in this example) and the column electrode D' in each of the discharge cells C' (an addressing discharge). As a result of the addressing discharge, lighted cells (the discharge cell in which a wall charge is formed on the dielectric layer 2) and non-lighted cells (the discharge cell in which a wall charge is not formed on the dielectric layer 2) are distributed over the panel surface in accordance with an image to be displayed.

After completion of the addressing period, a discharge sustaining pulse is simultaneously applied alternately to the row electrodes X' and Y' of each row electrode pair in each display line L. Every time the discharge sustaining pulse is applied, a sustaining discharge is caused between the row electrodes X' and Y' in each lighted cell by the wall charge formed on the dielectric layer 2.

The sustaining discharge in each lighted cell causes ultraviolet rays to generate from a xenon gas included in the discharge gas. The generated ultraviolet rays excites the red (R), green (G) or blue (B) phosphor layer 6 in each lighted cell C' to thereby form a display image.

In the conventional three-electrode surface discharge scheme alternating current type PDP as described above, the addressing discharge and the sustaining discharge are produced in the same discharge cell C'. Therefore, in each discharge cell C' the addressing discharge is initiated between the electrodes with the interposition of the red (R), green (G) or blue (B) phosphor layer 6 which is provided for emitting color when the sustaining discharge is caused.

For this reason, the addressing discharge produced in the discharge cell C' is subjected to influences ascribable to the phosphor layer 6, such as discharge properties varying with the phosphor materials of various colors forming the phosphor layers 6, variations in the thickness of layers produced when the phosphor layers 6 are formed in the manufacturing process, and the like. Hence, the conventional PDPs have a significant difficult problem for obtaining equal addressing discharge properties in each discharge cell C'.

In the aforementioned three-electrode surface-discharge-scheme alternating-current-type PDP, a large discharge space in each discharge cell C' is needed for increasing the luminous efficiency. Therefore, the prior art employs the method of increasing the height of the partition wall 5.

However, if the partition wall 5 is increased in height for increasing the luminous efficiency, the interval between the row electrode Y' and the column electrode D' between which the addressing discharge is produced is also increased. This increased interval produces a problem of an increase in a starting voltage for the addressing discharge.

Further, in the aforementioned three-electrode surface-discharge-scheme alternating-current-type PDP, the luminous efficiency of the PDP is enhanced by increasing the xenon-gas content in the discharge gas filling the discharge space S' to 10 percent or more, for example. However, if the xenon-gas content in the discharge gas is increased, a driving voltage for the addressing discharge and the sustaining discharge is also increased, leading to a problem of an increase in the electrical power consumption of the PDP.

SUMMARY OF THE INVENTION

The present invention has been made to solve the problems associated with the conventional surface-discharge-scheme alternating-current-type plasma display panel as described above.

Accordingly, it is a first object of the present invention to provide a surface-discharge-scheme alternating-current-type plasma display panel capable of stabilizing addressing discharge properties in each of discharge cells, and of enhancing luminous efficiency.

In addition to the first object, it is a second object of the present invention to provide a surface-discharge-scheme alternating-current-type plasma display panel capable of reducing driving voltage for an addressing discharge and a sustaining discharge.

To attain the first object, according to a first feature of the present invention, a plasma display panel including: a front substrate; a plurality of row electrode pairs arranged in a column direction on a back surface of the front substrate, and each extending in a row direction and forming a display line; a dielectric layer covering the row electrode pairs on the back surface of the front substrate; a back substrate placed opposite the front substrate with a discharge space interposed; and a plurality of column electrodes arranged in the row direction on a surface of the back substrate facing toward the front substrate, and each extending in the column direction to intersect the row electrode pairs and form unit light-emitting areas in the discharge space at the respective intersections, the plasma display panel comprises: partition walls surrounding each of the unit light-emitting areas to define the unit light-emitting areas; a dividing wall for dividing each of the unit light-emitting areas into a first discharge area facing mutually opposite parts of the respective row electrodes constituting each of the row electrode pairs and providing for a discharge produced between the mutually opposite row electrodes, and a second discharge area facing a part of one row electrode of the row electrodes initiating a discharge in association with the column electrode, and providing for the discharge produced between the column electrode and the part of the one row electrode; and a communicating element provided between the first discharge area and the second discharge area for communication from the second discharge area to the first discharge area.

In the plasma display panel in the first feature, when an image is generated, a discharge (addressing discharge) is caused between the column electrode and one of the row electrodes constituting each of the row electrode pairs, in the second discharge area (addressing discharge cell) formed in the unit light-emitting area divided off by the dividing wall. The discharge caused in the second discharge area is transferred through the communicating element provided between the first and second discharge areas, to the first discharge area, and spreads out into the first discharge area. Thus, the first discharge areas having a wall charge formed therein (lighted cells) and the first discharge areas having no wall charge formed therein (non-lighted cells) are distributed over the panel surface in accordance with the image to be generated.

After that, in each of the first discharge areas having the wall charge formed therein (lighted cells), another discharge (sustaining discharge) is caused between the mutually opposite parts of the respective row electrodes constituting each row electrode pair. Ultraviolet rays generated by the sustaining discharge excites phosphor layers of the three primary colors red (R), green (G) and blue (B) for emission of color light to form the image in response to an image signal on the panel surface.

According to the first feature, in this way, in order to distribute the unit light-emitting areas having the wall charge formed therein and the unit light-emitting areas having no wall charge formed therein over the panel surface, the addressing discharge is produced between the column electrode and one row electrode of the row electrode pair in a second discharge area, and the second discharge area is formed independently of the first discharge area in which the sustaining discharge is produced, after the completion of the addressing discharge, between the row electrodes constituting each of the row electrode pairs in order to emit light. For this reason, even if a discharge space of the first discharge area is designed to be larger for enhancement of the luminous efficiency of the plasma display panel and therefore a distance between the row electrode and the column electrode is increased, it is possible to place the column electrode in a position closer to the row electrode in the second discharge area than its position in the first discharge area, for a reduction in a starting voltage for the discharge between the column electrode and the row electrode. Thus, the enhancement of luminous efficiency and a reduction in a starting voltage for the discharge between the column electrode and the row electrode are attained at the same time.

Further, the independent design of the first discharge area for producing the discharge between the row electrodes of the row electrode pair and the second discharge area for producing the discharge between the column electrode and the row electrode, eliminates the need of forming a phosphor layer, emitting light by means of the discharge, in the second discharge area. The discharge caused between the column electrode and the row electrode in the second discharge area does not undergo the influences of the colors of phosphor materials forming the phosphor layers and the variations in the thickness of the phosphor layers, thus providing stabilized discharge properties between the column electrode and the row electrode.

To attain the first object, a plasma display panel has, in addition to the configuration of the first feature, a second feature in that each of the row electrodes constituting each of the row electrode pairs comprises an electrode body extending in the row direction, and transparent electrodes each protruding from the electrode body in the column direction in each unit light-emitting areas to face the other one of the row electrodes constituting the row electrode pair with a discharge gap between; and that the electrode body of at least one of the row electrodes is opposite the second discharge areas to allow the discharge to be caused between the electrode body and the column electrode in each second discharge area.

With the plasma display panel of the second feature, each of the row electrodes comprises the electrode body extending in the row direction and the transparent electrodes each connected to the electrode body in each of the unit light-emitting areas. The electrode body for initiating the discharge in association with the column electrode is positioned opposite the second discharge areas, so that an addressing discharge is produced between the electrode body and the column electrode in each of the second discharge areas.

To attain the first object, a plasma display panel has, in addition to the configuration of the first feature, a third feature in that each of the row electrodes constituting each of the row electrode pairs comprises an electrode body extending in the row direction, and transparent electrodes each protruding from the electrode body in the column direction in each unit light-emitting areas to face the other one of the row electrodes constituting the row electrode pair with a discharge gap between, and each having an extended part extending from the electrode body in the direction opposite to the transparent electrode of the other one of the row electrodes of the row electrode pair; and that the extended part of the transparent electrode of at least one of the row electrodes is opposite the second discharge area to allow the discharge to be caused between the extended part of the transparent electrode and the column electrode in the second discharge area.

With the plasma display panel of the third feature, the extended part is provided to each of the transparent electrodes which are each connected to the electrode body extending in the row direction in each unit light-emitting area and, form a row electrode together with the electrode body. The extended part extends from the connecting point of the transparent electrode with the electrode body in the direction opposite to a transparent electrode of the other one of the row electrodes paired, so as to be positioned opposite to the second discharge area. In this way, a discharge is produced between such an extended part and the column electrode in the second discharge area.

To attain the first object, a plasma display panel has, in addition to the configuration of the first feature, a fourth feature of further comprising an additional element jutting out from a part of the dielectric layer opposite each of the second discharge areas, in a direction of the second discharge area, and coming in contact with the partition walls defining the corresponding unit light-emitting area, to block the second discharge area from the unit light-emitting area adjacent thereto but not associated therewith.

With the plasma display panel of the fourth feature, the additional element is provided on the part of the dielectric layer covering the row electrode pairs opposite each of the second discharge areas, and in contact with the partition wall surrounding each of the unit light-emitting areas for dividing adjacent unit light-emitting areas off from each other. Due to such an additional element, a second discharge area formed in one unit light-emitting area is blocked off from an unconnected unit light-emitting area adjacent thereto. Thus the charged particles generated by the discharge between the column and row electrodes in the second discharge area, pass through the communicating element to flow into only the corresponding first discharge area of the unit light-emitting area concerned.

To attain the first object, a plasma display panel has, in addition to the configuration of the first feature, a fifth feature of further comprising a black or dark-colored light absorption layer provided on an area opposite each of the second discharge areas on the front substrate side.

With the plasma display panel of the fifth feature, a face of the second discharge area on the front substrate side, or on the display side, is covered with the black or dark-colored light absorption layer. The light absorption layer prevents the light generated by the discharge between the column and row electrodes in the second discharge area from leaking toward the display surface of the panel, and consequently from having an adverse effect on the image to be formed on the display surface of the panel. The light absorption layer also prevents the reflection of ambient light incident upon an area of the display surface of the panel oppose the second discharge area, thereby eliminating the possibility of an adverse effect upon the contrast in the image.

To attain the first object, a plasma display panel has, in addition to the configuration of the fifth feature, a sixth feature in that each of the row electrodes constituting each of the row electrode pairs comprises an electrode body extending in the row direction and transparent electrodes each protruding from the electrode body in the column direction in each unit light-emitting area to face the other one of the row electrodes constituting the row electrode pair with a discharge gap between; that the electrode body of at least one of the row electrodes is opposite the second discharge area to allow the discharge to be caused between the electrode body and the column electrode in the second discharge area; and that the light absorption layer is constituted by a black or dark-colored layer included in the electrode body of the row electrode, and a black or dark-colored layer formed in an area opposite to the second discharge area on the front substrate side.

With the plasma display panel of the sixth feature, each of the row electrodes comprises an electrode body extending in the row direction, and transparent electrodes each connected to the electrode body in each unit light-emitting area. The electrode body of the row electrode initiating the discharge in association with the column electrode is positioned opposite the second discharge area. Thus the discharge is produced between the electrode body and the column electrode in the second discharge cell.

The electrode body of the row electrode opposite to the second discharge area is formed of a black or dark-colored layer or is constructed partially of a black or dark-colored layer. Additionally, an area opposite to the second discharge area on the front substrate side in which the electrode bodies of the row electrodes are not formed is covered with a black or dark-colored layer. The provision of such black or dark-colored layers prevents the light generated by the addressing discharge between the column and row electrodes in the second discharge area from leaking toward the display surface of the panel, and consequently from having an adverse effect on the image to be formed on the display surface of the panel. In addition, the reflection of ambient light incident upon an area of the display surface of the panel opposite the second discharge area is prevented. As a result, the possibility of an adverse effect upon the contrast in the image is eliminated.

To attain the first object, a plasma display panel has, in addition to the configuration of the fifth feature, a seventh feature of further comprising an additional element jutting out from a part of the dielectric layer opposite each of the second discharge areas in a direction of the second discharge area, to come in contact with the partition walls defining the corresponding unit light-emitting area, to block the second discharge area from the unit light-emitting area adjacent thereto but not associated therewith, and formed of a black or dark-colored material to constitute the light absorption layer.

With the plasma display panel of the seventh feature, the additional element is provided on a part of the dielectric layer, overlying the row electrode pairs, opposite to each of the second discharge areas, and in contact with the partition wall surrounding each of the unit light-emitting areas for dividing adjacent unit light-emitting areas off from each other. Due to such an additional element, a second discharge area formed in one unit light-emitting area is blocked from an unconnected unit light-emitting area adjacent thereto, and thus the charged particles generated by the discharge between the column and row electrodes in the second discharge area pass through the communicating element to flow into only the corresponding first discharge area of the unit light-emitting area concerned. The additional element also constitutes the light absorption layer by being formed of the black or dark-colored material. Such a light absorption layer prevents the light generated by the discharge between the column and row electrodes in the second discharge area from leaking toward the display surface of the panel, and consequently from having an adverse effect on the image to be formed on the display surface of the panel, and it also prevents the reflection of ambient light incident upon an area of the display surface of the panel opposite the second discharge area, thereby eliminating the possibility of an adverse effect upon the contrast on the image.

To attain the first object, a plasma display panel has, in addition to the configuration of the first feature, an eighth feature of further comprising a phosphor layer provided only in the first discharge area for emitting light by means of the discharge.

With the plasma display panel of the eighth feature, a phosphor layer for emitting light by means of the discharge is not provided in the second discharge area provided for producing an addressing discharge between the column electrode and the row electrode. Hence, the addressing discharge in the second discharge area is not subject to the disadvantageous influences of differences in discharge properties produced by phosphor materials in the three primary colors forming the phosphor layers and variations in the thickness of the phosphor layers, whereby the discharge properties of the addressing discharge in the second discharge area are stabilized.

To attain the first object, a plasma display panel has, in addition to the configuration of the first feature, a ninth feature of further comprising a protrusion element provided in an area opposite to the second discharge area on the back substrate side and between the back substrate and the column electrode, and protruding into the second discharge area in the direction of the front substrate, to allow a part of the column electrode opposite each of the second discharge electrodes to jut out in the direction of the front substrate.

With the plasma display panel of the ninth embodiment, in each of the second discharge areas, the column electrode is raised from the back substrate to be brought closer to the row electrode by the protrusion element formed between the back substrate and the column electrode. Accordingly, a discharge distance between the column electrode and the row electrode in the second discharge area is smaller than a distance between the column and row electrodes in the first discharge area. It is possible to reduce a starting voltage for the discharge by shortening the discharge distance between the column electrode and the row electrode in each of the second discharge areas, while the large discharge space in the first discharge area remains unchanged.

To attain the first object, a plasma display panel has, in addition to the configuration of the first feature, a tenth feature of further comprising a priming particle generating layer provided in each of the second discharge areas of the unit light-emitting areas.

With the plasma display panel of the tenth feature, prior to the addressing discharge between the column And row electrodes in the second discharge area, a reset discharge to form (or erase) a wall charge is produced in the first discharge area to allow xenon included in a discharge gas to radiate ultraviolet rays. The ultraviolet rays excite the priming particle generating layer formed in the second discharge area to allow it to radiate ultraviolet rays. The ultraviolet rays excites a protective layer overlying the dielectric layer and the like to allow them to emit priming particles. Due to the afterglow characteristic of the priming particle generating layer, a sufficient quantity of the priming particles required for producing the addressing discharge is ensured in the second discharge area during the period of the addressing discharge in the second discharge area, resulting in prevention of the occurrence of a false discharge or a discharge time lag incident to a decrease in the priming particle quantities with the passage of time after the completion of the reset discharge.

To attain the first object, a plasma display panel has, in addition to the configuration of the tenth feature, an eleventh feature in that the priming particle generating layer is formed of a ultraviolet-region light emissive material having an afterglow characteristic of continuously radiating ultraviolet rays when the material is excited by ultraviolet rays having a predetermined wavelength.

With the plasma display panel of the eleventh feature, the afterglow characteristic of the ultraviolet-region light emissive material forming the priming particle generating layer prevents a decrease in quantity of the priming particles with the passage of time when the addressing discharge is produced between the column and row electrodes in the second discharge area. In turn, the occurrence of a false discharge or a discharge time lag incident to a decrease in priming particle quantities is prevented.

To attain the first object, a plasma display panel has, in addition to the configuration of the eleventh feature, a twelfth feature in that the ultraviolet-region light emissive material has an afterglow characteristic for 0.1 msec or more.

With the plasma display panel of the twelfth feature, the afterglow characteristic of the ultraviolet-region light emissive material forming the priming particle generating layer prevents a decrease in quantity of the priming particles with the passage of time when the addressing discharge is produced between the column and row electrodes in the second discharge area. Additionally, the afterglow characteristic continues for 0.1 msec or more. As a result, the occurrence of a false discharge or a discharge time lag incident to a decrease in priming particle quantities is fully prevented.

To attain the first object, a plasma display panel has, in addition to the configuration of the eleventh feature, a thirteenth feature in that the ultraviolet-region light emissive material has an afterglow characteristic for 1 msec or more.

With the plasma display panel of the thirteenth feature, the afterglow characteristic of the ultraviolet-region light emissive material forming the priming particle generating layer prevents a decrease in quantity of the priming particles with the passage of time when the addressing discharge is produced between the column and row electrodes in the second discharge area. Further, the afterglow characteristic continuing for 1 msec or more provides the priming particle quantities needed roughly for the duration of the addressing discharge. Thus, the occurrence of a false discharge or a discharge time lag incident to a decrease in priming particle quantities is further fully prevented.

To attain the first object, a plasma display panel has, in addition to the configuration of the eleventh feature, a fourteenth feature in that the priming particle generating layer includes a material having a work function of 4.2 eV or less.

With the plasma display panel of the fourteenth feature, the afterglow characteristic of the ultraviolet-region light emissive material forming the priming particle generating layer, allows the excited material having a work function of 4.2 eV or less (high $\gamma$ material) which is included in the priming particle generating layer, to continuously emit priming particles. Hence, when the addressing discharge is produced between the column and row electrodes in the second discharge area, a decrease in quantity of the priming particles with the passage of time is prevented, to provide a sufficient quantity of the priming particles needed for the addressing discharge. In turn, the occurrence of a false discharge or a discharge time lag incident to a decrease in priming particle quantities is prevented.

To attain the first object, a plasma display panel has, in addition to the configuration of the first feature, a fifteenth feature of further comprising a dielectric layer, formed of a material having a relative permittivity of 50 or more, provided in a position in each of the second discharge areas on the back substrate side in a form of being interposed between the column electrode and the part of the one row electrode initiating the discharge in association with the column electrode.

With the plasma display panel of the fifteenth feature, the dielectric layer having a relative permittivity of 50 or more is provided in each second discharge area, and shortens an apparent discharge distance between the column electrode and the row electrode in the second discharge area, thereby successfully reducing a starting voltage for the addressing discharge.

To attain the first object, a plasma display panel has, in addition to the configuration of the first feature, a sixteenth feature in that the communicating element is constituted by a clearance formed between the front substrate and the dividing wall by determining a height of the dividing wall dividing off the first discharge area and the second discharge area in each unit light-emitting area to be less than a height of the partition walls for defining the periphery of the unit light-emitting area.

With the plasma display panel of the sixteenth feature, even if a partition wall for defining the periphery of each unit light-emitting area is in contact with a part of a dielectric layer or the like provided on the front substrate to block adjacent unit light-emitting areas from each other, since the communication element is provided by the clearance which is formed between the dividing wall having a height less than that of the partition wall and dividing off the first discharge area and the second discharge area, and a part of the dielectric layer or the like provided on the front substrate, the charged particles generated by the discharge in the second discharge area are allowed to pass through the communicating element to flow into the first discharge area.

To attain the first object, a plasma display panel has, in addition to the configuration of the first feature, a seventeenth feature in that the communicating element is constituted by a groove formed in the dividing wall dividing off the first discharge area and the second discharge area, and having both ends opening toward the first discharge area and the second discharge area.

With the plasma display panel of the seventeenth feature, even if a partition wall for defining the periphery of each unit light-emitting area is in contact with a part of the dielectric layer or the like provided on the front substrate to block adjacent unit light-emitting areas from each other, since the communication element constituted by the groove which is formed in the dividing wall dividing off the first and second discharge areas permits communication from the second discharge area to the first discharge area, the charged particles generated by the discharge in the second discharge area pass through the communicating element to introduce into the first discharge area.

To attain the first object, a plasma display panel has, in addition to the configuration of the first feature, an eighteenth feature of further comprising an additional element jutting out from a part of the dielectric layer opposite each of the second discharge areas in a direction of the second discharge area, to come in contact with the partition walls defining each of the unit light-emitting areas, to block the second discharge area from the unconnected unit light-emitting area adjacent thereto, and the communicating element is formed in the additional element.

With the plasma display panel of the eighteenth feature, when the additional element jutting out from the dielectric layer in the direction of the back substrate is in contact with the partition wall for defining the periphery of each unit light-emitting area and the dividing wall for dividing off the first and second discharge areas, the communicating element formed in the additional element permits communication from the second discharge area to the first discharge area. Thus, the charged particles generated by the discharge in the second discharge area are introduced through the communication element into the first discharge area.

To attain the first object, a plasma display panel has, in addition to the configuration of the first feature, a nineteenth feature of further comprising either a high relative permittivity dielectric layer formed of a material having a required relative permittivity, or a conductor layer formed of an electrically-conductive material, provided on the back substrate in each of the second discharge areas.

In the plasma display panel of the nineteenth feature, either the high relative permittivity dielectric layer or the conductor layer provided in each of the second discharge areas decreases a discharge distance between the column electrode and the part of one row electrode of the paired row electrodes between which the addressing discharge is caused. Hence, the addressing discharge is started at a low discharge-starting voltage.

According to the nineteenth feature, even when a distance between the row electrode and the column electrode is increased by increasing a discharge space of the first discharge area for enhancement of the luminous efficiency of the plasma display panel, a discharge distance between the column electrode and one of the row electrodes in each of the second discharge areas is shortened by providing either the high relative permittivity dielectric layer or the conductor layer in each of the second discharge areas. Thus, a reduction in a starting voltage for the addressing discharge and the enhancement of luminous efficiency are attained at the same time.

To attain the first object, a plasma display panel has, in addition to the configuration of the nineteenth feature, a twentieth feature in that the material forming the high relative permittivity dielectric layer has a relative permittivity of 50 or more.

With the plasma display panel of the twentieth feature, the addressing discharge is produced between the column and row electrodes with the interposition of the dielectric layer having a relative permittivity of 50 or more in each of the second discharge areas. This design decreases an apparent discharge distance of the addressing discharge between the column electrode and the row electrode, so as to reduce a starting voltage for the addressing discharge.

To attain the first object, a plasma display panel has, in addition to the configuration of the nineteenth feature, a twenty-first feature in that the second discharge area is further divided into a first area positioned between the column electrode and the part of the one row electrode initiating the discharge in associated with the column electrode, and a second area having the area of the second discharge area with the exception of the first area, and either the high relative permittivity dielectric layer or the conductor layer is formed in the first area of the second discharge area.

With the plasma display panel of the twenty-first feature, the second discharge area is divided into the first area and the second area, and the high relative permittivity dielectric layer or the conductor layer is formed only in the first area which is positioned between the column electrode and the row electrode initiating the discharge in association with the column electrode. That is, a dielectric layer is not provided in an area unnecessary to start the addressing discharge. As a result, the plasma display panel is prevented from having an undesired interelectrode capacitance between adjacent column electrode, and consequently from having a reactive power.

To attain the first object, a plasma display panel has, in addition to the configuration of the twenty-first feature, a twenty-second feature of further comprising a priming particle generating layer provided in the second area of each of the second discharge areas.

With the plasma display panel of the twenty-second feature, prior to the addressing discharge between the column and row electrodes in the second discharge area, a reset discharge is produced in the first discharge area to allow xenon included in a discharge gas to radiate ultraviolet rays. The ultraviolet rays excite the priming particle generating layer formed in the second area of the second discharge area to allow it to radiate ultraviolet light. The ultraviolet light excites a protective layer overlying the dielectric layer and the like to allow them to emit priming particles. Due to the afterglow characteristic of the priming particle generating layer, a sufficient quantity of the priming particles required for producing the addressing discharge is ensured in the second discharge area during the period of the addressing discharge in the second discharge area, resulting in prevention of the occurrence of a false discharge or a discharge time lag incident to a decrease in the priming particle quantities with the passage of time after the completion of the reset discharge.

To attain the first object, a plasma display panel has, in addition to the configuration of the twenty-second feature, a twenty-third feature in that the priming particle generating layer is formed of a ultraviolet-region light emissive material having an afterglow characteristic of continuously radiating ultraviolet rays when the material is excited by ultraviolet rays having a predetermined wavelength.

With the plasma display panel of the twenty-third feature, the afterglow characteristic of the ultraviolet-region light emissive material forming the priming particle generating layer prevents a decrease in quantity of the priming particles with the passage of time when the addressing discharge is produced between the column and row electrodes in the second discharge area. In turn, the occurrence of a false discharge or a discharge time lag incident to a decrease in priming particle quantities is prevented.

To attain the first object, a plasma display panel has, in addition to the configuration of the twenty-third feature, a twenty-fourth feature in that the ultraviolet-region light emissive material has an afterglow characteristic for 0.1 msec or more.

With the plasma display panel of the twenty-fourth feature, the afterglow characteristic of the ultraviolet-region light emissive material forming the priming particle generating layer prevents a decrease in quantity of the priming particles with the passage of time when the addressing discharge is produced between the column and row electrodes in the second discharge area.

Further, the afterglow characteristic continues for 0.1 msec or more. As a result, the occurrence of a false discharge or a discharge time lag incident to a decrease in priming particle quantities is fully prevented.

To attain the first object, a plasma display panel has, in addition to the configuration of the twenty-third feature, a twenty-fifth feature in that the ultraviolet-region light emissive material has an afterglow characteristic for 1 msec or more.

With the plasma display panel of the twenty-fifth feature, the afterglow characteristic of the ultraviolet-region light emissive material forming the priming particle generating layer prevents a decrease in quantity of the priming particles with the passage of time when the addressing discharge is produced between the column and row electrodes in the second discharge area.

Additionally, the afterglow characteristic continuing for 1 msec or more provides the priming particle quantities needed roughly for the duration of the addressing discharge. Thus, the occurrence of a false discharge or a discharge time lag incident to a decrease in priming particle quantities is further fully prevented.

To attain the first object, a plasma display panel has, in addition to the configuration of the twenty-second feature, a twenty-sixth feature in that the priming particle generating layer includes a material having a work function of 4.2 eV or less.

With the plasma display panel of the twenty-sixth feature, the afterglow characteristic of the ultraviolet-region light emissive material forming the priming particle generating layer, allows the excited material having a work function of 4.2 eV or less which is included in the priming particle generating layer, to continuously emit priming particles. Hence, when the addressing discharge is produced between the column and row electrodes in the second discharge area, a decrease in quantity of the priming particles with the passage of time is prevented, to provide a sufficient quantity of the priming particles needed for the addressing discharge. In turn, the occurrence of a false discharge or a discharge time lag incident to a decrease in priming particle quantities is prevented.

To attain the first object, a plasma display panel has, in addition to the configuration of the nineteenth feature, a twenty-seventh feature of further comprising a high relative permittivity dielectric layer provided on a face, facing the front substrate, of the conductor layer formed in each of the second discharge areas.

With the plasma display panel of the twenty-seventh feature, a discharge distance of the addressing discharge produced between the column electrode and one row electrode of the paired row electrodes in the second discharge area is shortened by the conductor layer formed in the second discharge area, and therefore a starting voltage for the addressing discharge is decreased. An apparent discharge distance between the conductor layer and the one row electrode is decreased by the high relative permittivity dielectric layer formed on the face of the conductor layer, and therefore a starting voltage for the addressing discharge is further decreased.

To attain the first object, a plasma display panel has, in addition to the configuration of the nineteenth feature, a twenty-eighth feature in that the conductor layer is formed on a column-electrode protective layer covering the column electrodes, and is electrically connected to the column electrode through a conducting element with the interposition of the column-electrode protective layer.

With the plasma display panel of the twenty-eighth, due to the electrical connection between the conductor layer and the column electrode through the conducting element with the interposition of the column-electrode protective layer, a discharge distance between the column electrode and one row electrode of the paired row electrodes is further decreased, to significantly reduce a starting voltage for the addressing discharge.

To attain the first object, a plasma display panel has, in addition to the configuration of the twenty-eighth feature, a twenty-ninth feature in that the conducting element electrically connecting the conductor layer to the column electrode is a through hole formed in the column-electrode protective layer.

With the plasma display panel of the twenty-ninth feature, the conductor layer and the column electrode are electrically connected by the through hole, formed in the column-electrode protective layer, with the interposition of the column-electrode protective layer concerned, whereby a discharge distance between the column electrode and one row electrode of the paired row electrodes is further decreased, resulting in a significant decrease of a starting voltage for the addressing discharge.

To attain the first object, a plasma display panel has, in addition to the configuration of the nineteenth feature, a thirtieth feature in that the one row electrodes and the other row electrodes constituting the row electrode pairs are arranged in alternate positions in each display line in the column direction such that the one row electrodes of the adjacent row electrode pairs are arranged back to back and the other row electrodes of the adjacent row electrode pairs are arranged back to back; that either the high relative permittivity dielectric layer or the conductor layer is formed in the second discharge area opposite to the parts of the back-to-back one row electrodes individually causing the discharge in association with the column electrode; and that a space formed between either the high relative permittivity dielectric layer or the conductor layer and the dielectric layer covering the row electrode pairs, is divided by a rib member extending in the row direction into areas respectively facing the parts of the one row electrodes arranged back to back.

With the plasma display panel of the thirtieth feature, in the arrangement of the row electrodes of two kinds consisting the row electrode pairs, the row electrodes of the same kind of the respective row electrode pairs adjacent to each other are arranged back to back in the column direction. Due to such an arrangement, discharge capacity is not formed in the non-display area between the row electrodes positioned back to back when a discharge sustaining pulse is applied across the row electrode pair and the sustaining discharge is initiated between the row electrodes, resulting in prevention of reactive power.

To attain the second object, a plasma display panel has, in addition to the configuration of the first feature, a thirty-first feature in that parts of the row electrodes, constituting each of the row electrode pairs, for initiating the discharge therebetween, are opposite each other with an empty space between.

With the plasma display panel of the thirty-first feature, in a position opposite to a first discharge area in which the wall charge is formed by the addressing discharge produced in the second discharge area (a lighted cell), a discharge (sustaining discharge) is caused between the opposite parts of the row electrodes of the row electrode pair with the interposition of an empty space which is formed between the parts of the row electrodes concerned. Ultraviolet rays generated by the sustaining discharge excite the phosphor layer of a red (R), green (G) or blue color (B) of the three primary colors formed in each of the first discharge areas to allow it to emit light. An image is thus formed on the panel surface in response to an image signal.

According to the thirty-first feature, due to the design in which the sustaining discharge is caused between the opposite parts of the row electrodes of the row electrode pair with the interposition of the empty space which is formed between the opposite parts concerned, a distance of an electric line force passing through the inside of the dielectric layer when the sustaining discharge is caused is shortened, and therefore the electric field strength of the electric line force is increased considerably more than that in the prior art. For this reason, even when a xenon-gas content in the discharge gas is increased for enhancement of the luminous efficiency of the sustaining discharge, it is possible to produce the discharge at a low driving voltage.

To attain the second object, a plasma display panel has, in addition to the configuration of the thirty-first feature, a thirty-second feature in that the empty space is constituted by a recess formed in a part of the dielectric layer positioned between the parts of the row electrodes initiating the discharge therebetween.

With the plasma display panel of the thirty-second feature, the recess is formed in a part of the dielectric layer positioned between the parts of the row electrodes of the row electrode pair initiating the discharge therebetween, and an empty space in the recess is interposed between the opposite parts of the row electrodes causing the sustaining discharge.

To attain the second object, a plasma display panel has, in addition to the configuration of the thirty-second feature, a thirty-third feature in that the recess is formed in an island-like form in each of the first discharge areas.

With the plasma display panel of the thirty-third feature, the recess interposed between the parts of the row electrodes causing the sustaining discharge therebetween is formed independently in a circular- or quadrangular-shaped island form in each first discharge area.

To attain the second object, a plasma display panel has, in addition to the configuration of the thirty-second feature, a thirty-fourth feature in that the recess is formed in a band shape extending in the row direction and continuing between the first discharge areas adjacent to each other in the row direction.

With the plasma display panel of the thirty-fourth feature, the recess interposed between the parts of the row electrodes of the row electrode pair causing the sustaining discharge therebetween has a band shape extending in the row direction, and is formed in such a manner as to span adjacent first discharge areas in the row electrode.

To attain the second object, a plasma display panel has, in addition to the configuration of the thirty-first feature, a thirty-fifth feature in that the parts of the row electrodes constituting each of the row electrode pairs for initiating the discharge therebetween are opposite each other in a face-to-face form.

In the plasma display panel of the thirty-fifth feature, the part of each of the row electrodes of the row electrode pair between which the sustaining discharge is caused is shaped by, for example, being bent in a direction of either the front substrate or the back substrate in relation to a part of its row electrode extending in parallel to the front substrate, so that the parts of the both the row electrodes are opposite each other in a face-to-face form.

With this design, when compared to a conventional case where a sustaining discharge is produced between parts of the row electrodes which are end-to-end with each other, an electric line force of the sustaining discharge passes through a decreased discharge-distance, so that the electric field strength thereof is increased. For this reason, even in the use of a discharge gas with a high xenon-gas content, it is possible to further reduce driving voltage required for causing the sustaining discharge.

To attain the second object, a plasma display panel has, in addition to the configuration of the thirty-first feature, a thirty-sixth feature in that each of the row electrodes constituting each of the row electrode pairs comprises an electrode body extending in the row direction, and transparent electrodes each protruding from the electrode body in the column direction in each unit light-emitting areas to face the other one of the row electrodes constituting the row electrode pair with a discharge gap between; and that the electrode body of at least one of the row electrodes is opposite the second discharge areas to allow the discharge to be caused between the electrode body and the column electrode in each second discharge area.

With the plasma display panel of the thirty-sixth feature, each of the row electrodes comprises the electrode body extending in the row direction and the transparent electrodes each connected to the electrode body in each of the unit light-emitting areas. The electrode body for initiating the discharge in association with the column electrode is positioned opposite the second discharge areas, so that an addressing discharge is produced between the electrode body and the column electrode in each of the second discharge areas.

To attain the second object, a plasma display panel has, in addition to the configuration of the thirty-first feature, a thirty-seventh feature in that each of the row electrodes constituting each of the row electrode pairs comprises an electrode body extending in the row direction, and transparent electrodes each protruding from the electrode body in the column direction in each unit light-emitting areas to face the other one of the row electrodes with a discharge gap between, and each having an extended part extending from the electrode body in the direction opposite to the transparent electrode of the other one of the row electrodes of the row electrode pair; and that the extended part of the transparent electrode of at least one of the row electrodes is opposite the second discharge area to allow the discharge to be caused between the extended part of the transparent electrode and the column electrode in each second discharge area.

With the plasma display panel of the thirty-seventh feature, the extended part is provided to each of the transparent electrodes which are each connected to the electrode body extending in the row direction in each unit light-emitting area and form a row electrode together with the electrode body. The extended part extends from the connecting point of the transparent electrode with the electrode body in the direction opposite to a transparent electrode of the other one of the row electrodes paired, so as to be positioned opposite to the second discharge area. In this way, a discharge is produced between such an extended part and the column electrode in the second discharge area.

These and other objects and advantages of the present invention will become obvious to those skilled in the art upon review of the following description, the accompanying drawings and appended claims.

DETAILED DESCRIPTION OF THE PREFERRED EMBODIMENTS

Preferred embodiments according to present invention will be described below in detail with reference to the accompanying drawings.

Figure 1:
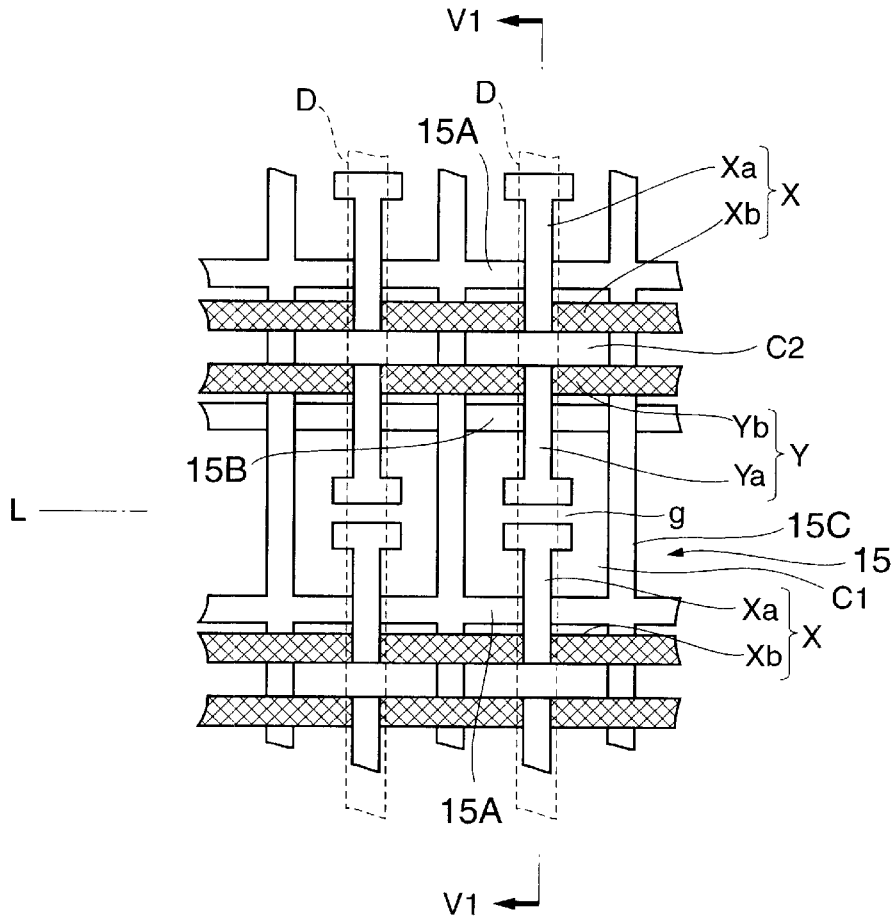
FIG. 1 is a schematic front view of a first embodiment according to the present invention.
Figure 2:
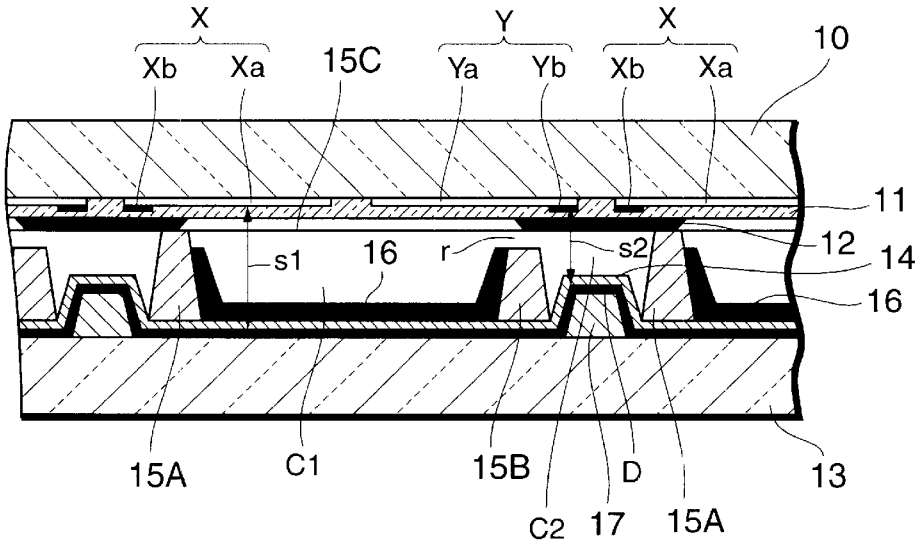
FIG. 2 is a sectional view taken along the V1—V1 line in FIG. 1.
Figure 3:
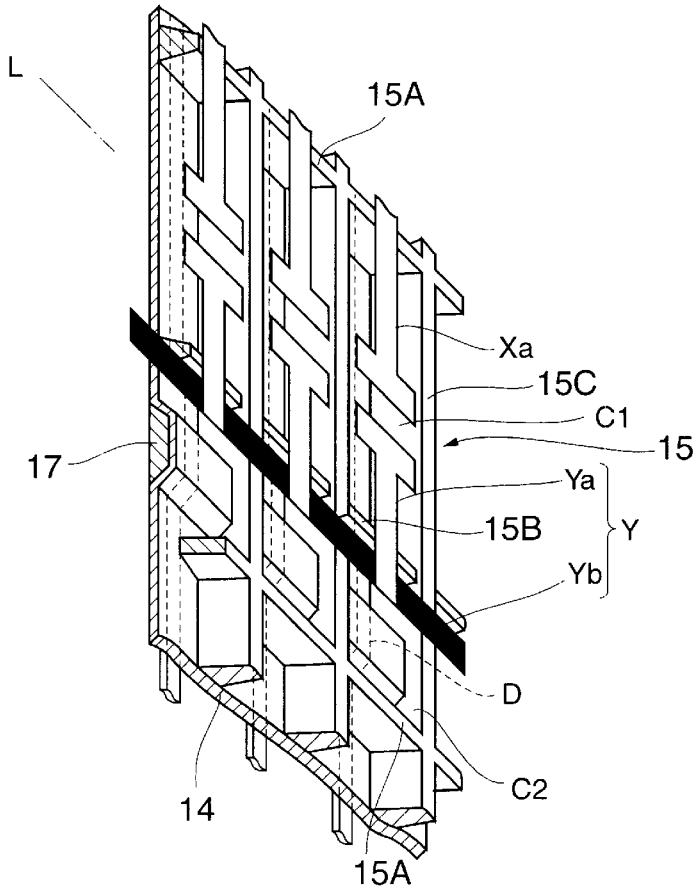
FIG. 3 is a perspective view in the first embodiment.

FIG. 1 to FIG. 3 are schematic views illustrating a first embodiment of a plasma display panel (hereinafter referred to as "PDP") according to the present invention. FIG. 1 is a front view of part of the cell structure of the PDP in the first embodiment. FIG. 2 is a sectional view taken along the V1—V1 line of FIG. 1. FIG. 3 is a perspective view of the first embodiment.

The PDP illustrated in FIGS. 1 to 3 includes a front glass substrate 10 serving as a display surface. A plurality of row electrode pairs (X, Y) are arranged on the back surface of the front glass substrate 10, and each extend in a row direction of the substrate 10 (in the left-right direction of FIG. 1).

Each of the row electrodes X includes transparent electrodes Xa each of which is formed of a transparent conductive film made of ITO or the like constructed in a letter-T shape, and a black bus electrode Xb which is formed of a wide metal film extending in the row direction of the front glass substrate 10 and connected to a base end, having a smaller width, of the transparent electrode Xa.

Likewise, each of the row electrodes Y includes transparent electrodes Ya each of which is formed of a transparent conductive film made of ITO or the like constructed in a letter-T shape, and a black bus electrode Yb which is formed of a wide metal film extending in the row direction of the front glass substrate 10 and connected to a base end, having a smaller width, of the transparent electrode Ya.

The row electrodes X and Y are alternated in position in a column direction (the vertical direction in FIG. 1, and the left-right direction in FIG. 2) of the front glass substrate 10. The transparent electrodes Xa and Ya are arranged at regular intervals along the corresponding bus electrodes Xb an Yb, and the paired transparent electrodes Xa and Ya extend in the direction of the other of the row electrode pair in such a way that leading ends, having a larger width, of the respective paired transparent electrodes Xa and Ya are opposite each other with the interposition of a discharge gap g having a required width.

Each of the row electrode pairs (X, Y) forms a display line L extending in the row direction.

On the back surface of the front glass substrate 10, a dielectric layer 11 is formed so as to cover the row electrode pairs (X, Y). On the back surface of the dielectric layer 11, an additional dielectric layer 12 protrudes backward from the back surface of the dielectric layer 11 (downward in FIG. 2) in a position opposite to a predetermined area, as described later, including the adjacent bus electrodes Xb and Yb of the respective row electrode pairs (X, Y) adjacent to each other, and also it extends in parallel to the bus electrodes Xb, Yb.

The additional dielectric layer 12 also serves as a light absorption layer including black or dark-colored pigments.

The back surfaces of the dielectric layer 11 and additional dielectric layers 12 are covered with a protective layer made of MgO (not shown).

The front glass substrate 10 is situated in parallel to a back glass substrate 13 having a surface facing the display surface on which a plurality of column electrodes D are arranged parallel to each other at predetermined intervals and each extend in a direction at right angles to the bus electrodes Xb, Yb (in the column direction) in a position opposite to the paired transparent electrodes Xa and Ya in each of the row electrode pairs (X, Y).

On the surface of the back glass substrate 13 on the display surface side, a white column-electrode protective layer (dielectric layer) 14 covers the column electrodes D, and a partition wall 15 shaped as described below are formed on the column-electrode protective layer 14.

The partition wall 15 is constructed by, when viewed from the front glass substrate 10, first transverse walls 15A each of which extends in the row direction along the edge of the bus electrode Xb of each row electrode X on the side facing the bus electrode Yb of the row electrode Y paired therewith; second transverse walls 15B each of which extends in parallel to the edge of the bus electrode Yb of each row electrode Y on the side facing the bus electrode Xb of the row electrode X paired therewith, at a predetermined interval from the first transverse wall 15A; and vertical walls 15C each of which extends in the column direction in a position between adjacent transparent electrodes Xa plus adjacent transparent electrodes Ya which are arranged at regular intervals along the corresponding bus electrodes Xb, Yb of the row electrodes X, Y.

The first transverse wall 15A and the vertical wall 15C are each designed to be of a height equal to a distance between the protective layer covering the back surface of the additional dielectric layer 12 and the column-electrode protective layer 14 covering the column electrode D. The second transverse wall 15B is designed to be of a height slightly smaller than that of the first transverse wall 15A and vertical wall 15C. That is, a front surface of the first transverse wall 15A (the upper surface in FIG. 2), and a front face of the vertical wall 15C between the first transverse wall 15A and the second transverse wall 15B are in contact with the back surface of the protective layer covering the additional dielectric layer 12, whereas the second transverse wall 15B is out of contact with the back surface of the protective layer covering the additional dielectric layer 12 and a clearance r is formed between the front surface of the wall 15B and the protective layer covering the additional dielectric layer 12.

The first and second transverse walls 15A and 15B and vertical wall 15C of the partition wall 15 partition the discharge space between the front and back glass substrates 10 and 13 into areas each opposite to the transparent electrodes Xa and Ya paired with and facing each other, to thereby define display discharge cells C1. Further, the vertical walls 15C partition a space which is formed between the first and second transverse walls 15A and 15B and opposite to the back-to-back bus electrodes Xb and Yb of adjacent row electrode pairs (X, Y), to thereby define addressing discharge cells C2 which alternate with the display discharge cells C1 in the column direction.

The display discharge cell C1 and the addressing discharge cell C2 adjacent to each other with the second transverse wall 15B in the column direction in between are connected with each other through the clearance r which is formed between the front face of the second transverse wall 15B and the protective layer covering the additional dielectric layer 12.

A phosphor layer 16 overlies all the five faces inside each display discharge cell C1, made up of one face of the column-electrode dielectric layer 14 and the four side faces of the first and second transverse walls 15A and 15B and vertical walls 15C of the partition wall 15. The three primary colors red, green and blue are applied to the phosphor layers 16 each provided in a display discharge cell C1, and arranged in order a red color (R), a green color (G) and a blue color (B) in the row direction.

On a face of the back glass substrate 13 opposite to each addressing discharge cell C2, a protrusion rib 17 protrudes from the face of the substrate 13 on the display surface side into the addressing discharge cell C2 with a height less than that of the second transverse wall 15B, and extends in a band shape in the row direction.

Thus, part of the column electrode D opposite to each addressing discharge cell C2 and the column-electrode protective layer 14 covering the part of column electrode D is raised from the back glass substrate 13 by the protrusion rib 17 to protrude into each addressing discharge cell C2, and therefore a space-distance s2 between the part of the column electrode D opposite to the addressing discharge cell C2 and the bus electrodes Xb and Yb is smaller than a space-distance s1 between part of the column electrode D opposite to the display discharge cell C1 and the transparent electrodes Xa, Ya.

The protrusion rib 17 may be formed of the same dielectric material as that of the column-electrode protective layer 14. Alternatively, the protrusion rib 17 may be constituted by forming projections and depressions on the front surface of the back glass substrate 13 by means of sandblast or wet etching.

Each display discharge cell C1 and each addressing discharge cell C2 are filled with a discharge gas.

Such a PDP generates images through the following procedure.

First, in each of the display discharge cells C1, a reset discharge in a reset period is caused to form a wall charge on the surface of the dielectric layer 11.

In an addressing period following the reset period, a scanning pulse is applied to the row electrode Y and a data pulse is applied to the column electrode D.

Thereupon, an addressing discharge is initiated at an intersection of the row electrode Y applied with the scanning pulse and the column electrode D applied with the data pulse between the electrodes Y and D. In this point, the addressing discharge is produced mainly between the part of the column electrode D protruded into the addressing discharge cell C2 by the protrusion rib 17 and the bus electrode Yb of the row electrode Y, because the space-distance s2 between the bus electrode Yb of the row electrode Y and the column electrode D which are opposite each other in the addressing discharge cell C2 is smaller than the space-distance s1 between the transparent electrode Ya of the row electrode Y and the column electrode D which are opposite each other in the display discharge cell C1.

The charged particles generated by the addressing discharge in the addressing discharge cell C2 pass through the clearance r formed between the second transverse wall 15B and the additional dielectric layer 12, and flow into the display discharge cell C1 adjoining to the addressing discharge cell C2 with the second transverse wall 15B in between, to erase the wall charge formed on the dielectric layer 11 facing the display discharge cell C1. Thus, lighted cells (the display discharge cell C1 in which the wall charge is formed on the dielectric layer 11) and non-lighted cells (the display discharge cell C1 in which the wall charge is not formed on the dielectric layer 11) are distributed in all display lines L over the panel surface in accordance with an image to be displayed.

In a sustaining light-emission period after the completion of the addressing period, a discharge sustaining pulse is simultaneously applied alternately to each row electrode pair (X, Y) in each display line L. Every time the discharge sustaining pulse is applied, a sustaining discharge is initiated between the opposite transparent electrodes Xa and Ya in each lighted cell, and therefore ultraviolet rays is generated. The generated ultraviolet rays excites each of the red (R), green (G) and blue (B) phosphor layers 16 facing the display discharge cells C1 to thereby form a display image.

With the above PDP, the addressing discharge for distributing the lighted cells and the non-light cells over the panel surface in accordance with the image to be displayed and the sustaining discharge for allowing the phosphor layers 16 to emit color light are independently produced in individual discharge cells. This design can successfully accomplish two objects at the same time: a reduction in a starting voltage for the addressing discharge due to the fact that the protrusion rib 17 provides a smaller space-distance s2 between the column electrode D and the bus electrode Yb of the row electrode Y in the addressing discharge cell C2, and an increase in the luminous efficiency due to the fact that a discharge space in the display discharge cell C1 is designed to be larger (i.e. there is a larger space-distance s1 between transparent electrodes Xa, Ya and the column electrode D).

Further, in the PDP, the addressing discharge is produced in the addressing discharge call C2 without the phosphor layer, so that a stable addressing discharge is provided without being subject to the influences of discharge properties varying with the phosphor materials with various colors forming the phosphor layers, variations in the thickness of the phosphor layer, and the like as conventional PDPs do in which an addressing discharge is caused between two electrodes with the interposition of a phosphor layer.

Figure 4:
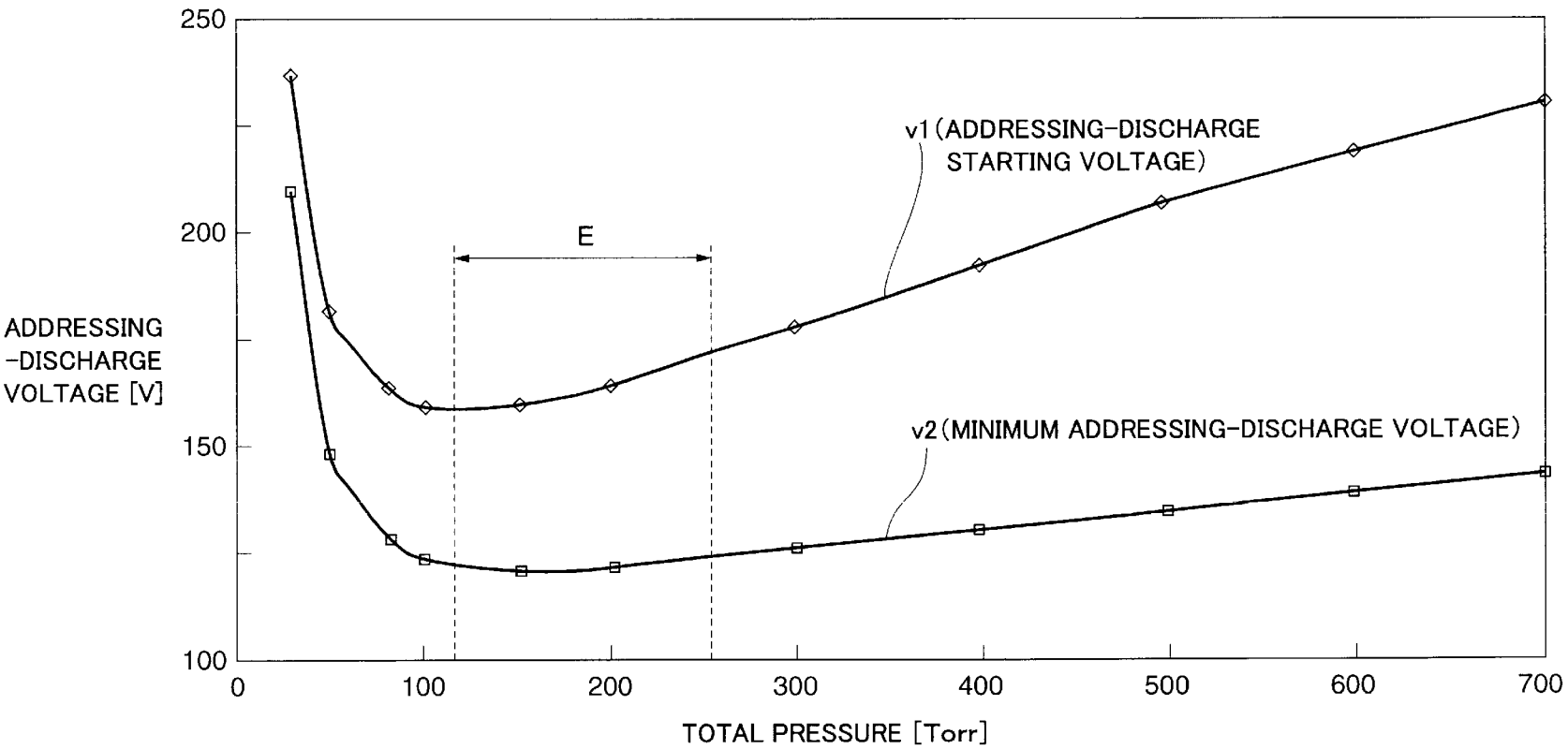
FIG. 4 is a graph showing Paschen characteristics for setting a distance for an addressing discharge in the first embodiment.

When determining a space-distance s2 between the column electrode D and the bus electrode Yb in the addressing discharge cell C2, it is preferred to refer, in the graph of Paschen properties shown in FIG. 4, a range in which an addressing-discharge starting voltage indicated by the line v1 showing starting voltages for the addressing discharge is low and shows positive characteristics (characteristics of increasing discharge-voltage values with an increase in pressure in the discharge space), namely, an area of the line v1 around the lowest point thereof and to the right of the lowest point (the area indicated by "E" in FIG. 4).

In this way, when the space-distance s2 is determined such that an addressing-discharge starting voltage falls into the area E of the line v1, it is possible to decrease a starting voltage for the addressing discharge in the PDP. Further, a small variation in a discharge voltage due to pressure in the area E allows variations in height of the protrusion rib 17 (i.e. variations of the space-distance s2) to have a minimized influence on the addressing discharge voltage.

It should be mentioned that in the first embodiment the space-distance s2 is determined at 70 $\mu$m.

In the above PDP, the charged particles generated by the addressing discharge in one addressing discharge cell C2 pass through the clearance r formed between the additional dielectric layer 12 and the second transverse wall 15B, and flow into the display discharge cell C1 in which the transparent electrode Ya extends from the bus electrode Yb involved in the initiation of the addressing discharge. In this point, the additional dielectric layer 12 is in contact with the first transverse wall 15A and the vertical wall 15C, to block the addressing discharge cell C2 concerned from the unconnected display discharge cell C1 to which the cell C2 concerned is adjacent in the opposite column direction, and from addressing discharge cells C2 to which the cell C2 concerned is adjacent on both sides in the row direction. Thus, the charged particles are prevented from flowing into such an unconnected display discharge cell C1 and addressing discharge cells C2 adjacent to the addressing discharge cell C2 concerned.

Charged particles generated by the sustaining discharge in the display discharge cell C1 are also prevented from flowing into an unconnected addressing discharge cell C2 adjacent thereto by the additional dielectric layer 12.

Further, the additional dielectric layer 12 serving as a light absorption layer including black or dark pigments prevents light generated at the addressing discharge in the addressing discharge cell C2 from leaking toward the display surface of the front glass substrate 10, and also prevents the reflection of ambient light passing through the front glass substrate 10 onto the area corresponding to the addressing discharge cell C2, resulting in improvement in contrast of the display image.

For communicating between a display discharge cell C1 and the corresponding addressing discharge cell C2, in the foregoing, the clearance r is formed between the additional dielectric layer 12 and the second transverse wall 15A by determining the height of the second transverse wall 15B to be lower than that of the first transverse wall 15A. Alternatively, a groove communicating between a display discharge cell C1 and the corresponding addressing discharge cell C2 may be formed on the top of a second transverse wall having the same height as that of the first transverse wall 15A. As a further alternative, a groove communicating between a display discharge cell C1 and the corresponding addressing discharge cell C2 may be formed on an additional dielectric layer in contact with a second transverse wall having the same height as that of the first transverse wall 15A. As yet another alternative, a second transverse wall having the same height as that of the first transverse wall 15A may be positionally staggered from an additional dielectric layer to form a clearance communicating between a display discharge cell C1 and the corresponding addressing discharge cell C2.

Figure 5:
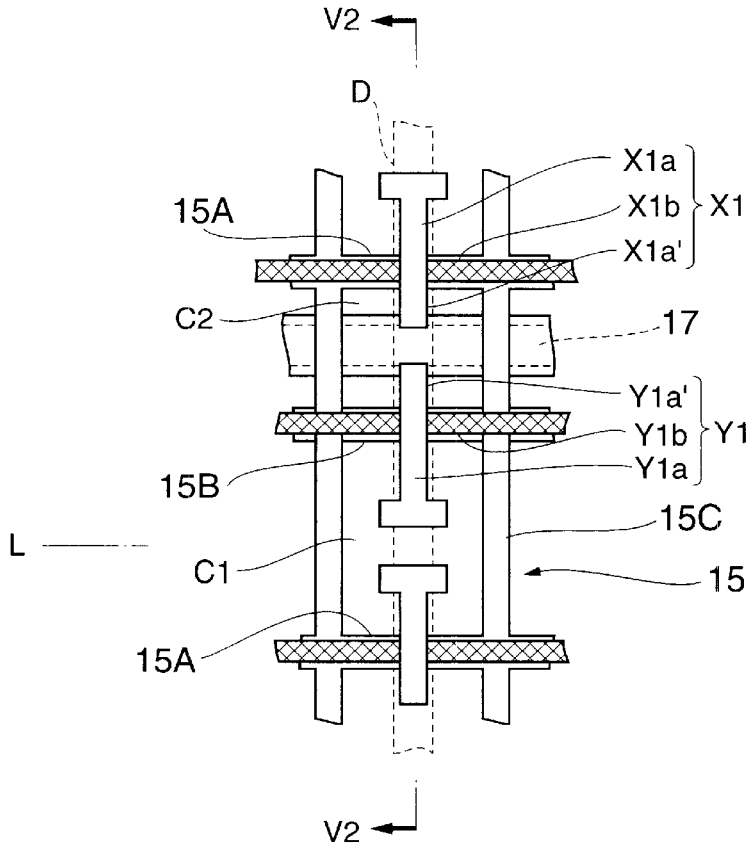
FIG. 5 is a schematic front view of a second embodiment according to the present invention.
Figure 6:
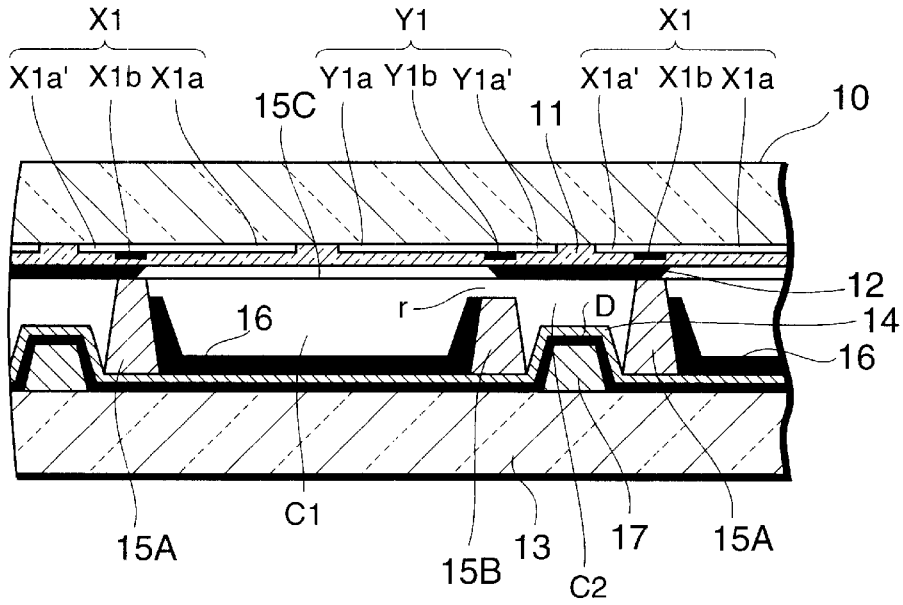
FIG. 6 is a sectional view taken along the V2—V2 line in FIG. 5.

FIG. 5 and FIG. 6 are views schematically illustrating a second embodiment of PDP according to the present invention. FIG. 5 is a front view of part of the cell structure of the PDP in the second embodiment. FIG. 6 is a sectional view along the V2—V2 line in FIG. 5.

In the PDP of the second embodiment, a bus electrode X1*b* of a row electrode X1 is placed in a position opposite a first transverse wall 15A. A base end X1*a*' of a transparent electrode X1*a* connected to the bus electrode X1*b* extends to a position opposite part of a column electrode D, positioned on a protrusion rib 17, with an addressing discharge cell C2 interposed.

Likewise, a bus electrode Y1*b* of a row electrode Y1 is placed in a position opposite a second transverse wall 15B. A base end Y1*a*' of a transparent electrode Y1*a* connected to the bus electrode Y1*b* extends to a position opposite part of a column electrode D, positioned on a protrusion rib 17, with an addressing discharge cell C2 interposed.

The configuration of other components in the second embodiment is approximately the same as that of the PDP in the first embodiment, and therefore the same reference numerals are used.

The first embodiment describes the addressing discharge produced between the bus electrode Yb and the column electrode D on the protrusion rib 17 in the addressing discharge cell C2, whereas the second embodiment describes the PDP in which an addressing discharge is caused between the column electrode D on the protrusion rib 17, and the base end Y1*a*' of the transparent electrode Ya extending from the bus electrode to a position opposite to the addressing discharge cell C2.

Figure 7:
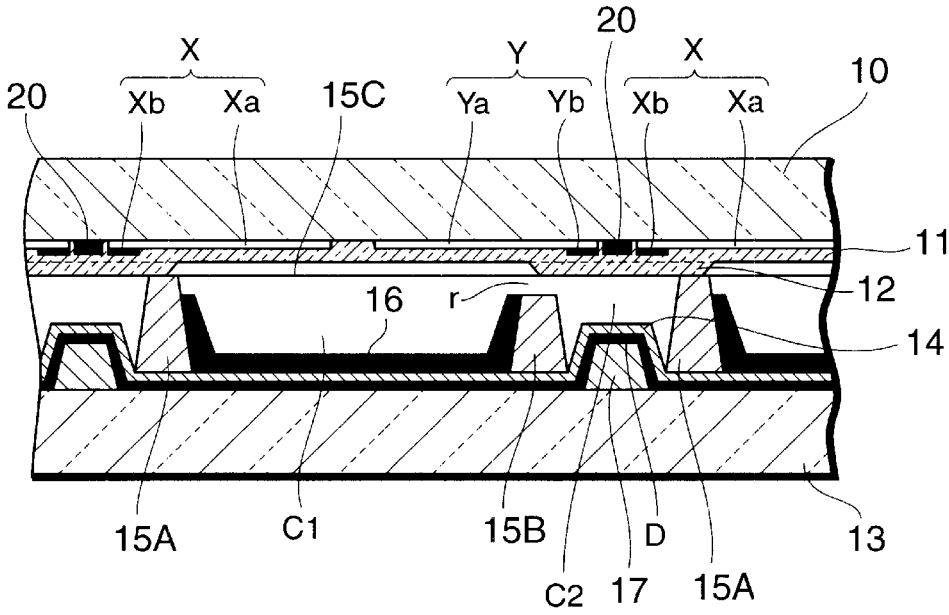
FIG. 7 is a schematic sectional view of a third embodiment according to the present invention.

FIG. 7 is a sectional view of a PDP according to a third embodiment of the present invention which is taken at the same position as in that in FIG. 2.

The PDP in the third embodiment has a similar configuration to that in the PDP in the first embodiment, in which each of the bus electrodes Xb, Yb of the respective row electrodes X, Y is positioned opposite to the addressing discharge cell C2 and has a black conductive layer. Between the bus electrodes Xb and Yb positioned back to back in adjacent display lines L and opposite the same addressing discharge cell C2, a black or dark-colored light absorption layer 20 extends in the row direction. The light absorption layer 20 and the black or dark conductive layers of the bus electrodes Xb and Yb cover a face of the addressing discharge cell C2 facing the front glass substrate 10.

The configuration of other components in the third embodiment is approximately the same as that of the PDP in the first embodiment, and therefore the same reference numerals are used.

With the PDP according to the third embodiment, the light generated in the addressing discharge cell C2 is blocked by the light absorption layer 20 and the black or dark conductive layers of the bus electrodes Xb and Yb, and prevented from leaking toward the display surface of the front glass substrate 10. Also, the reflection of ambient light passing through the front glass substrate 10 onto the area corresponding to the addressing discharge cell C2 is prevented. As a result, the contrast in the display image is improved.

Figure 8:
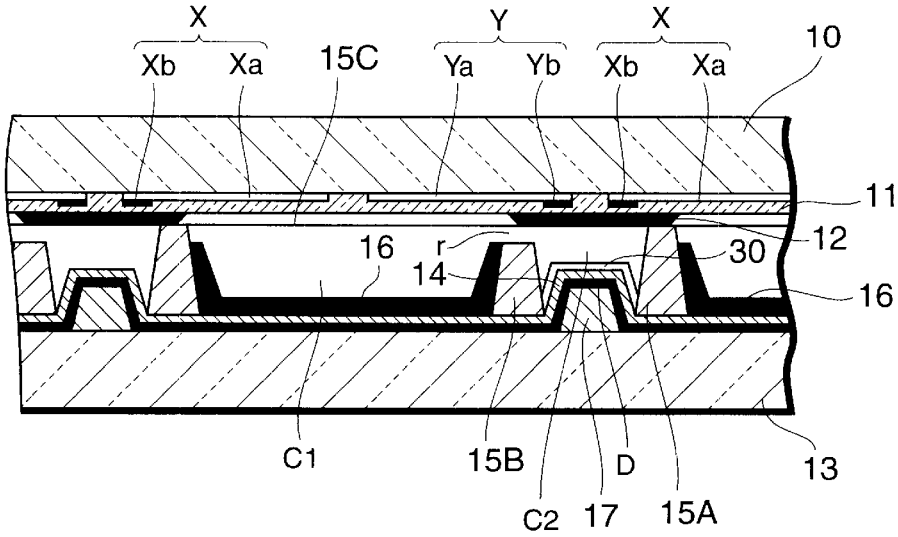
FIG. 8 is a schematic sectional view of a fourth embodiment according to the present invention.
Figure 9:
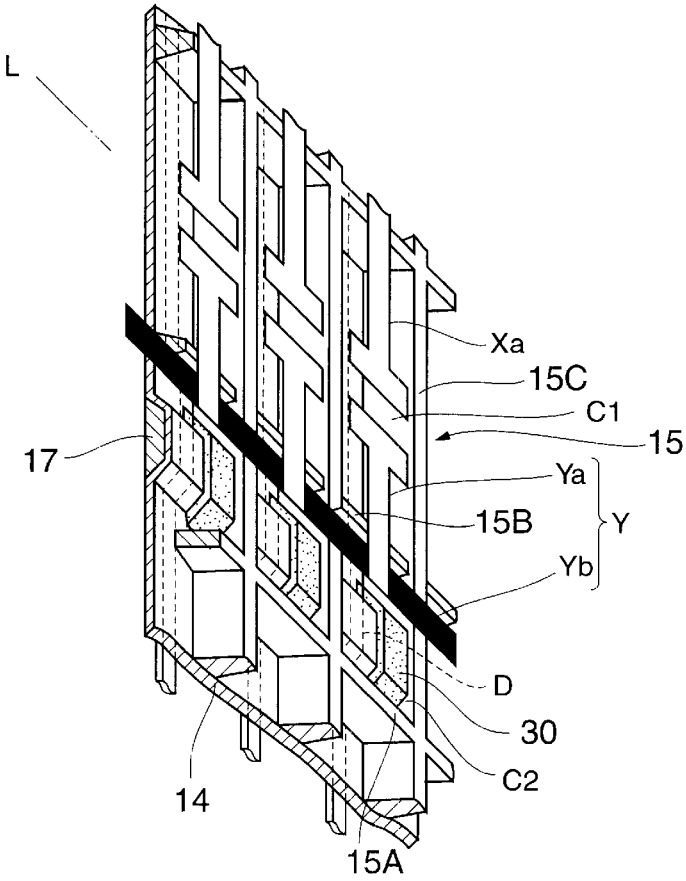
FIG. 9 is a perspective view of the fourth embodiment.

FIG. 8 and FIG. 9 are schematic views illustrating a fourth embodiment of a PDP according to the present invention. FIG. 8 is a sectional view of the PDP in the fourth embodiment which is taken at the same position as that in FIG. 2. FIG. 9 is a perspective view of the fourth embodiment.

The PDP in the fourth embodiment has a similar configuration to that of the PDP in the first embodiment, but a priming particle generating layer 30 is provided in each addressing discharge cell C2 on parts of the column-electrode protective layer 14, first transverse wall 15A, second transverse wall 15B and vertical wall 15C which are not opposite to the column electrode D.

The priming particle generating layer 30 is formed of ultraviolet-region light emissive materials having an afterglow characteristic in which, for example, the material is excited by ultraviolet rays having a predetermined wavelength or more, to continuously emit ultraviolet rays for 0.1 msec or more, preferably, for the length of the addressing period or more (e.g. 1.0 msec or more).

The priming particle generating layer 30 formed of the ultraviolet region light emissive material may include a material having a lower work function (e.g. 4.2 eV or less), namely, a material having a higher coefficient of secondary electron emission (a high γ (gamma) material).

Examples of materials having a small work function and insulation properties include: oxides of alkali metals (e.g. $Cs_2O$: work function 2.3 eV); oxides of alkali-earth metals (e.g. CaO, SrO, BaO); fluorides (e.g. $CaF_2$, $MgF_2$); a material which crystal defects, impurities, or the like are caused in crystal to produce an imperfection level for an increase in a coefficient of secondary electron emission (e.g. MgOx having a composition ratio of Mg:O changed from 1:1 to cause crystal defects); $TiO_2$; $Y_2O_3$; and so on.

Another ultraviolet region light emissive materials have an afterglow characteristic in which when the materials are excited by a 147 nm-wavelength vacuum ultraviolet light radiated from xenon included in the discharge gas by a discharge, to continuously emit ultraviolet rays for 0.1 msec or more, preferably, 1.0 msec or more (i.e. a time length of an addressing period or more). Examples of such ultraviolet region light emissive materials include $BaSi_2O_5:Pb^{2+}$ (a wavelength of emitted light: 350 nm), $SrB_4O_7F:Eu^{2+}$ (a wavelength of emitted light: 360 nm), (Ba, Mg, $Zn)_3Si_2O_7:Pb^{2+}$ (a wavelength of emitted light: 295 nm), $YF_3$:Gd, Pr, and so on.

The configuration of other components in the fourth embodiment is approximately the same as that of the PDP in the first embodiment, and therefore the same reference numerals are used.

In the PDP of the fourth embodiment, the 147 nm-wavelength vacuum ultraviolet light is radiated from xenon included in the discharge gas by a reset discharge of a concurrent reset period in which wall charges are formed (or erased) in all the display discharge cells C1, and then excites the priming particle generating layer 30 provided in each addressing discharge cell C2 to allow it to emit ultraviolet light. The ultraviolet light excites the protective layer (MgO layer) overlying the additional dielectric layer 12 and the high γ material of the priming particle generating layer 30 if it includes this, to allow them to emit priming particles.

The priming particle generating layer 30 continuously emits the ultraviolet light for at least 0.1 msec or more due to the afterglow characteristic of the ultraviolet-region light emissive materials forming the layer 30. Hence, during the addressing period following the concurrent reset period, a sufficient quantity of priming particles in each addressing discharge cell C2 can be ensured to cause an addressing discharge. Accordingly, the occurrence of a false discharge or a discharge time lag incident to a decrease in priming particle quantities with the passage of time after the completion of the reset discharge is prevented.

Figure 10:
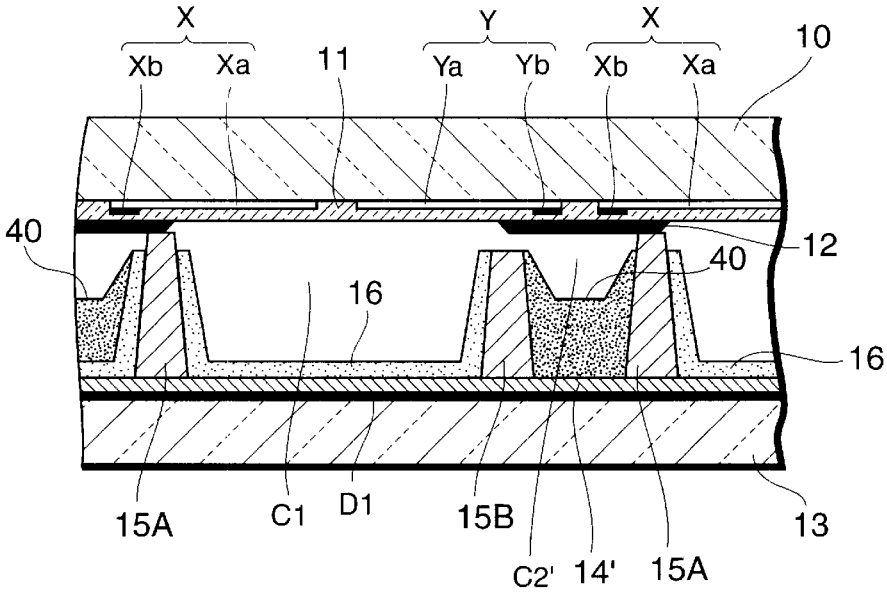
FIG. 10 is a schematic sectional view of a fifth embodiment according to the present invention.
Figure 11:
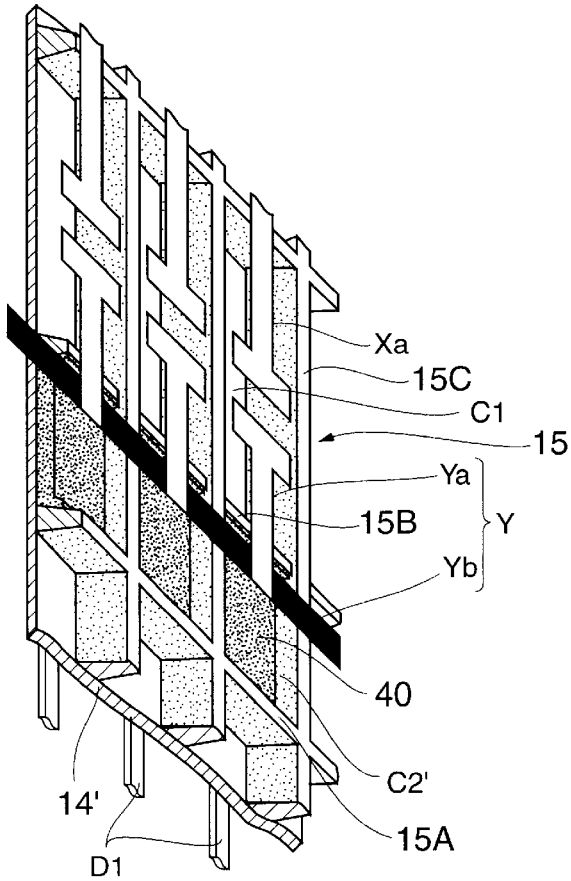
FIG. 11 is a perspective view in the fifth embodiment.

FIG. 10 and FIG. 11 are schematic views illustrating a fifth embodiment of the PDP according to the present invention. FIG. 10 is a sectional view of the PDP in the fifth embodiment which is taken at the same position as that in FIG. 2. FIG. 11 is a perspective view in the fifth embodiment.

The PDP in the fifth embodiment differs from the PDPs in the first to fourth embodiments in that the protrusion rib is not provided for bringing the column electrode closer to the bus electrode in each addressing discharge cell, and therefore a column electrode D1 is shaped in a straight line shape even in an area corresponding to an addressing discharge cell C2'.

In the addressing discharge cell C2', a dielectric layer 40 formed of high ϵ (epsilon) materials having 50 or more (50 to 250) of a relative permittivity (ϵ) are provided so as to reduce the discharge space in each addressing discharge cell C2' (a space-distance between the bus electrode Yb and the dielectric layer 40).

Examples of high ϵ materials for the dielectric layer 40 include $SrTiO_3$.

The configuration of other components in the fifth embodiment is approximately the same as that of the PDP in the first embodiment, and therefore the same reference numerals are used.

In the PDP of the fifth embodiment, the addressing discharge is produced between the electrodes D and Yb with the interposition of the high ϵ materials forming the dielectric layer 40 in the addressing discharge cell C2', and the high ϵ materials has 50 or more of a relative permittivity (ϵ). Hence, an apparent discharge-distance between the column electrode D1 and the bus electrode Yb which cause the addressing discharge is shortened, resulting in a reduction in starting voltage for the addressing discharge.

Figure 12:
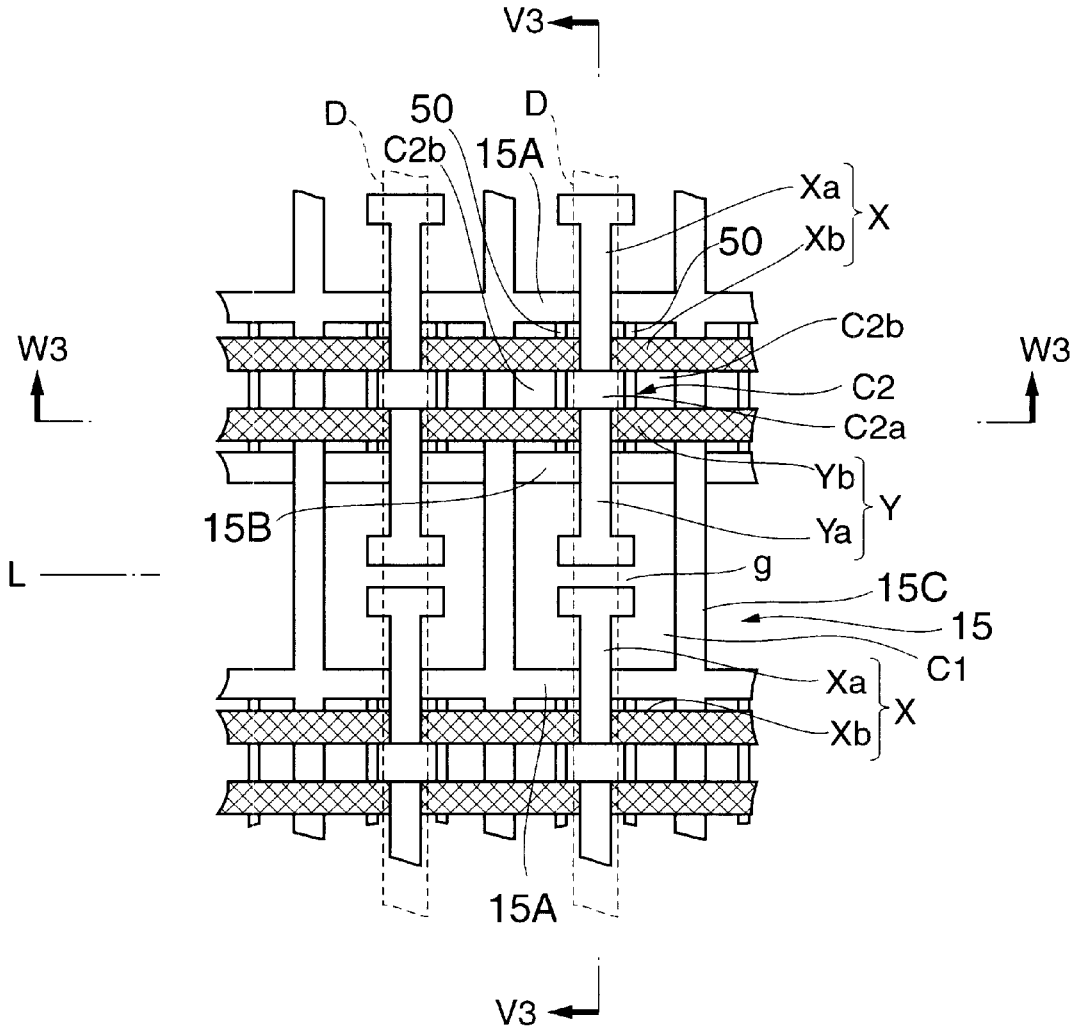
FIG. 12 is a schematic front view of a sixth embodiment according to the present invention.
Figure 13:
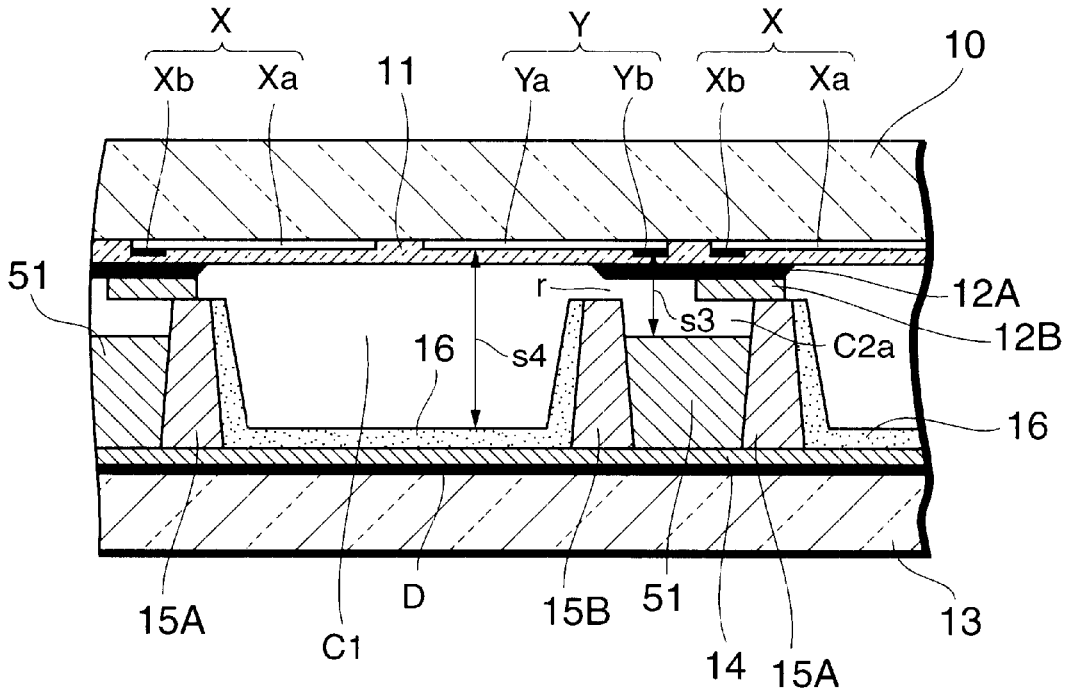
FIG. 13 is a sectional view taken along the V3—V3 line in FIG. 12.
Figure 14:
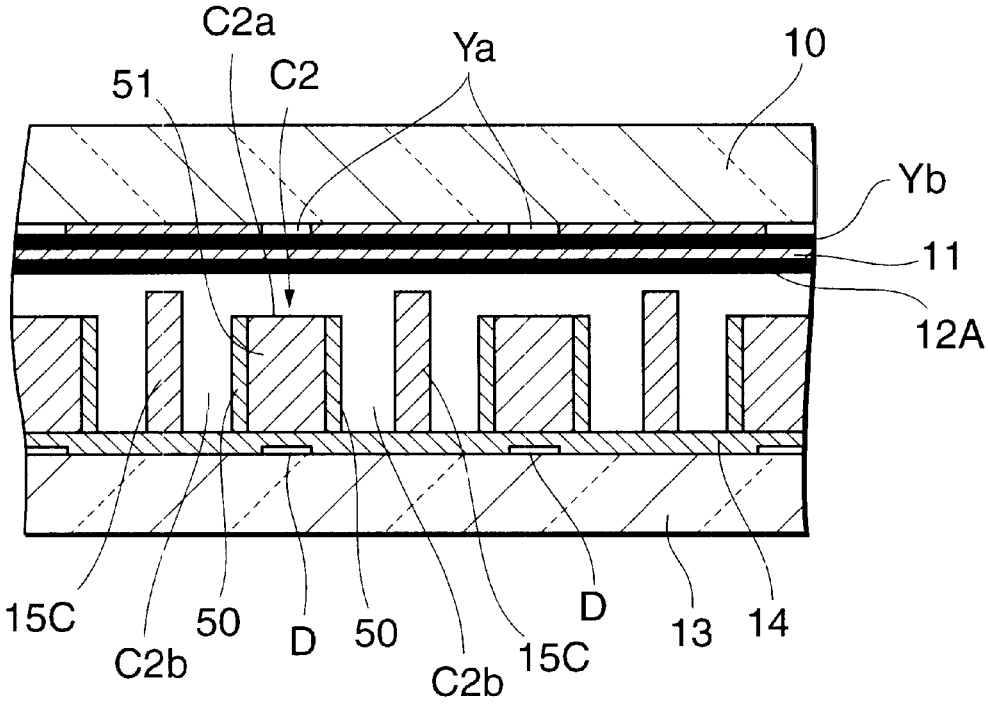
FIG. 14 is a sectional view taken along the W3—W3 line in FIG. 12.
Figure 15:
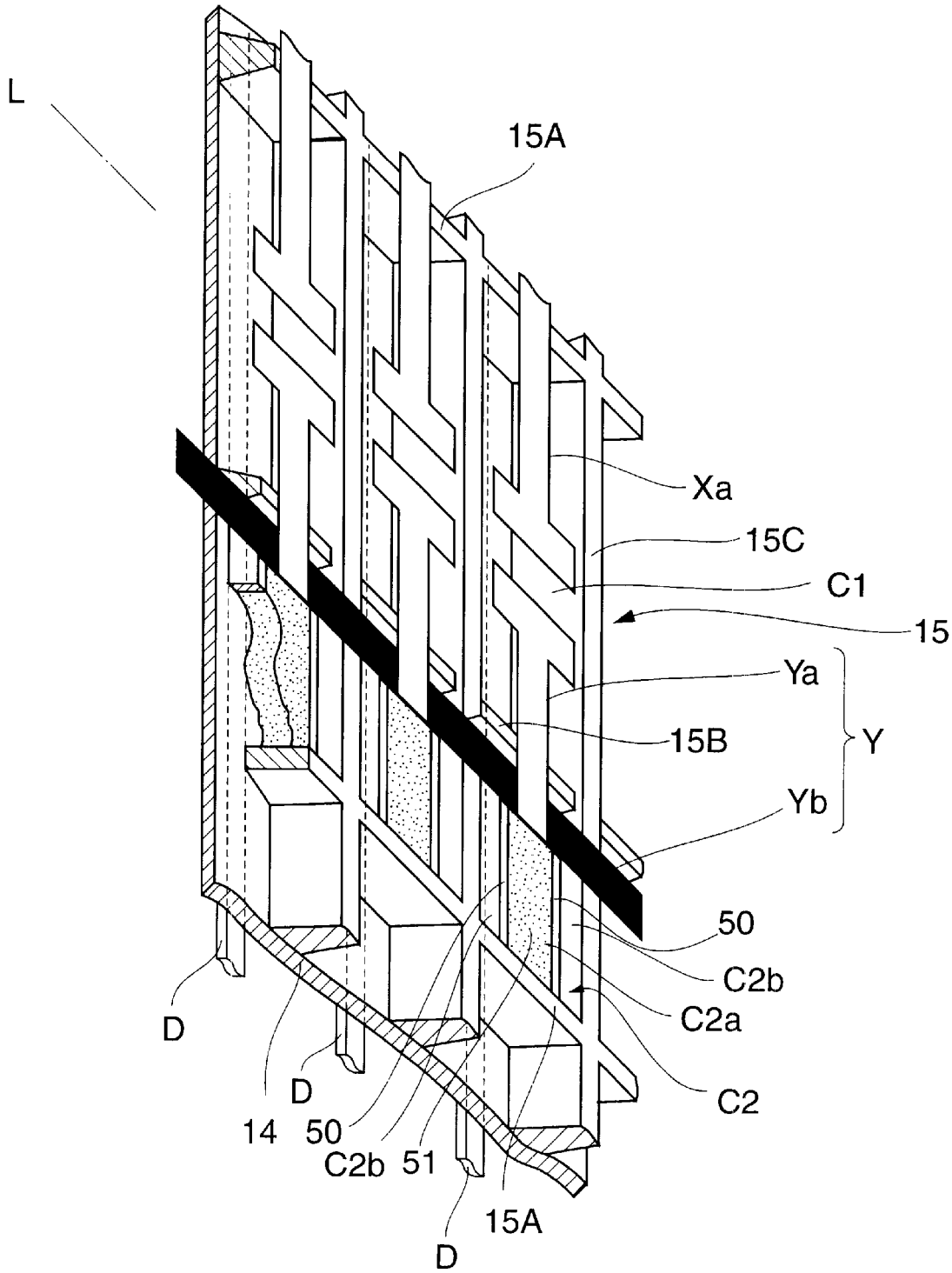
FIG. 15 is a perspective view of the sixth embodiment.

FIG. 12 to FIG. 15 are schematic views illustrating a sixth embodiment of a PDP according to the present invention. FIG. 12 is a front view of part of the cell structure of the PDP in the sixth embodiment. FIG. 13 is a sectional view along the V3—V3 line in FIG. 12. FIG. 14 is a sectional view along the W3—W3 line in FIG. 12. FIG. 15 is a perspective view of the sixth embodiment.

The configuration of a basic structure of the PDP illustrated in FIG. 12 to FIG. 15 is approximately the same as the configuration of the PDP in the first embodiment (FIGS. 1 to 3), and the components the same as or similar to those of the PDP in the first embodiment are designated by the same or similar reference numerals.

In the addressing discharge cell C2 of the PDP in the sixth embodiment, a pair of vertical ribs 50 extend in the column direction between the first transverse wall 15A and the second transverse wall 15B on both sides of the column electrode D. The pair of vertical ribs 50 further divides the inside of the addressing discharge cell C2 into a first addressing discharge cell C2*a* positioned in a central part of the addressing discharge cell C2 and opposite to the column electrode D, and second addressing discharge cells C2*b* positioned on both sides of the first addressing discharge cell C2*a*.

Each of the first addressing discharge cells C2*a* is provided therein with a dielectric layer 51 formed of a material having a high relative permittivity (e.g. ϵ=50 to 250) such as $SrTiO_3$ (hereinafter referred to as "the high ϵ materials"). The dielectric layer 51 reduces the discharge space in each first addressing discharge cell C2*a* (a space-distance between the bus electrode Yb and the dielectric layer 51).

There is nothing formed inside each of the second addressing discharge cells C2*b* positioned on both sides of the first addressing discharge cell C2*a*, that is the second addressing discharge cell C2*b* is hollow.

Each of the display discharge cells C1 and addressing discharge cells C2 is filled with a discharge gas.

Images are generated on the PDP as follows.

First, wall charges are formed on the surface of the dielectric layer 11 in each display discharge cell C1 through the reset discharge in the reset period.

In the addressing period following the reset period, a scanning pulse is applied to the row electrode Y and a data pulse is applied to the column electrode D.

In this point, due to the high e materials forming the dielectric layer 51 in the first addressing discharge cell C2*a* of the addressing discharge cell C2, an virtual discharge distance s3 between the column electrode D and the bus electrode Yb is shorter than a distance s4 between the column electrode D and transparent electrode Ya which are opposite each other with the display discharge cell C1 between. Hence, the addressing discharge is caused between the column electrode D and bus electrode Yb which are opposite each other with the first addressing discharge cell C2*a* between.

Charged particles generated by the addressing discharge in the first addressing discharge cell C2*a* pass through a clearance r between the second transverse wall 15B and a first additional dielectric layer 12A, and then flow into a display discharge cell C1 adjoining the cell C2*a* concerned with the second transverse wall 15B in between, to erase the wall charge formed on part of the dielectric layer 11 facing the discharge cell C1. Thus lighted cells (the display discharge cells C1 in which the wall charge is formed on the dielectric layer 11) and non-lighted cells (the display discharge cells C1 in which the wall charge is not formed on the dielectric layer 11) are distributed over the panel surface in accordance with the image to be displayed.

In this point, the charged particles generated by the addressing discharge at one addressing discharge cell C2 do not flow into an unconnected display discharge cell C1 adjacent to the cell C2 concerned with the first transverse wall 15A between, because a second additional dielectric layer 12B is provided so as to block the cell C2 concerned from the unconnected cell C1.

In a sustaining light-emission period after the completion of the addressing period, a discharge sustaining pulse is simultaneously applied alternately to the row electrode pairs (X, Y) in each display line L. Every time the discharge sustaining pulse is applied, a sustaining discharge is initiated between the opposite transparent electrodes Xa and Ya in each lighted cell, and therefore ultraviolet rays are generated. The generated ultraviolet rays excite the red (R), green (G) or blue (B) phosphor layer 16 facing the display discharge cells C1, to thereby form a display image.

With the above PDP, the addressing discharge is produced in the addressing discharge cell C2 provided independently of the display discharge cell C1 in which the sustaining discharge is produced. The addressing discharge between the electrodes Yb and D is produced with the interposition of the high $\epsilon$ materials forming the dielectric layer 51 in the first addressing discharge cell C2*a*, and therefore an apparent discharge distance between the column electrode D and the bus electrode Yb is shortened, so that a starting voltage for the addressing discharge is considerably decreased as compared with that in the prior art.

In the PDP, further, the addressing discharge cell C2 is divided into the first addressing discharge cell C2*a* and the second addressing discharge cells C2*b* by the vertical ribs 50, and the dielectric layer 51 is formed only in the first addressing discharge cell C2*a* positioned opposite the column electrode D in a central part of the addressing discharge cell C2, in which a dielectric layer unnecessary for starting the addressing discharge is not formed. This design does not permit the PDP to have an undesired interelectrode capacitance between adjacent column electrodes D, resulting in prevention of unnecessary electric power consumption.

Still further, in the PDP, the addressing discharge is produced in the addressing discharge cell C2 formed independently of the display discharge cell C1 in which the sustaining discharge is produced. For this reason, it is possible to enhance the luminous efficiency by means of defining a larger discharge space in the display discharge cell C1 (a longer distance s4 between the transparent electrodes Xa, Ya and the column electrode D) without having influence on a discharge starting voltage for the addressing discharge.

Figure 16:
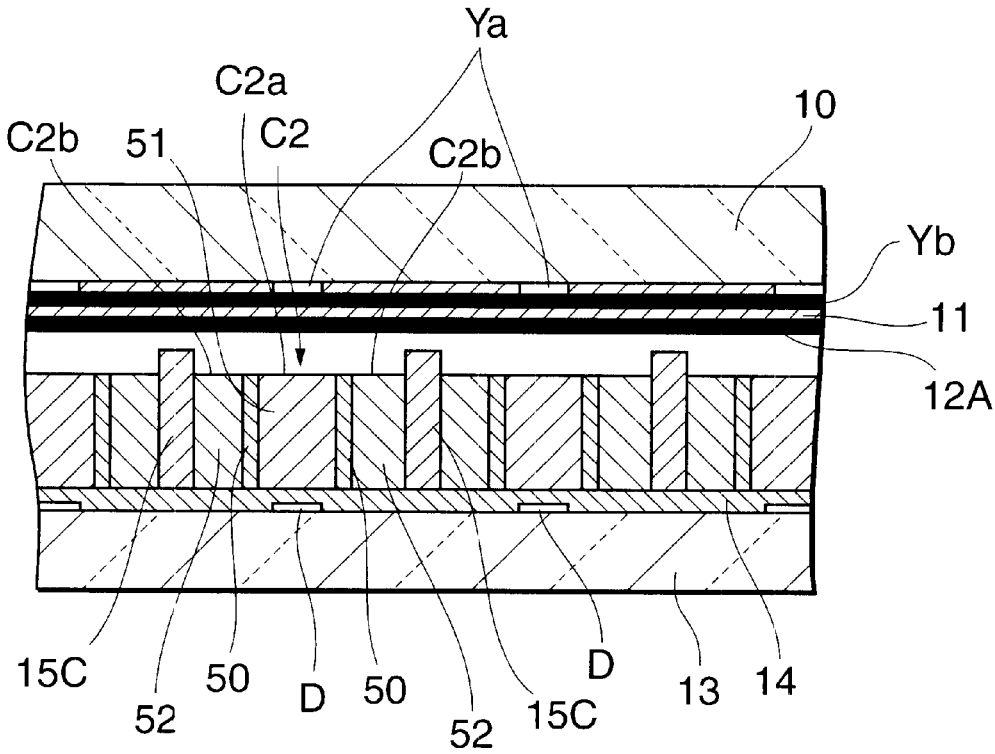
FIG. 16 is a schematic sectional view of a seventh embodiment according to the present invention.

FIG. 16 is a sectional view illustrating a seventh embodiment of a PDP according to the present invention which is taken in the same position as that in FIG. 14 of the sixth embodiment.

In the PDP in the seventh embodiment, a priming particle generating layer 52 is provided in each of the second addressing discharge cells C2*b* which have been designed to be hollow in the sixth embodiment.

The priming particle generating layer 52 is made of ultraviolet-region light emissive materials having an afterglow characteristic in which, for example, the material is excited by ultraviolet rays having a predetermined wavelength or more, to continuously emit ultraviolet rays for 0.1 msec or more, preferably, for the length of the addressing period or more (e.g. 1.0 msec or more).

The priming particle generating layer 52 made of the ultraviolet region light emissive material may include a material having a lower work function (e.g. 4.2 eV or less), namely, a material having a higher coefficient of secondary electron emission (a high $\gamma$ material).

Examples of the materials having a small work function and insulation properties include: oxides of alkali metals (e.g. $Cs_2O$: work function 2.3 eV); oxides of alkali-earth metals (e.g. CaO, SrO, BaO); fluorides (e.g. $CaF_2$, $MgF_2$); a material which crystal defects, impurities, or the like are caused in crystal to produce an imperfection level for an increase in a coefficient of secondary electron emission (e.g. MgOx having a composition ratio of Mg:O changed from 1:1 to cause crystal defects); $TiO_2$; $Y_2O_3$; and so on.

Another ultraviolet region light emissive materials have afterglow characteristics in which when the materials are excited by a 147 nm-wavelength vacuum ultraviolet light radiated from xenon included in the discharge gas by a discharge, to continuously emit ultraviolet light for 0.1 msec or more, preferably, 1.0 msec or more (i.e. a time length of an addressing period or more). Examples of such ultraviolet region light emissive materials include $BaSi_2O_5:Pb^{2+}$ (a wavelength of emitted light: 350 nm), $SrB_4O_7F:Eu^{2+}$ (a wavelength of emitted light: 360 nm), $(Ba, Mg, Zn)_3Si_2O_7:Pb^{2+}$ (a wavelength of emitted light: 295 nm), $YF_3$:Gd, Pr, and so on.

The configuration of other components in the seventh embodiment is approximately the same as that of the PDP in the sixth embodiment, and therefore the same reference numerals are used.

In the PDP of the seventh embodiment, the 147 nm-wavelength vacuum ultraviolet rays is radiated from xenon included in the discharge gas through a reset discharge in a concurrent reset period in which a wall charge is formed (or erased) in all the display discharge cells C1, and then excites the priming particle generating layer 52 provided in each second addressing discharge cell C2*b* to allow it to emit ultraviolet rays. The ultraviolet light excites the protective layers (MgO layers) overlying the first and second additional dielectric layers 12A and 12B and the high $\gamma$ material of the priming particle generating layer 52 if the layer 52 includes it, to allow them to emit priming particles.

The priming particle generating layer 52 continuously emits the ultraviolet rays for at least 0.1 msec or more due to the afterglow characteristic of the ultraviolet-region light emissive materials forming the layer 52. Hence, during the addressing period following the concurrent reset period, a sufficient quantity of priming particles can be ensured in each addressing discharge cell C2 to cause an addressing discharge, resulting in prevention of the occurrence of a false discharge or a discharge time lag incident to a decrease in the priming particle quantities with the passage of time after the completion of the reset discharge.

Figure 17:
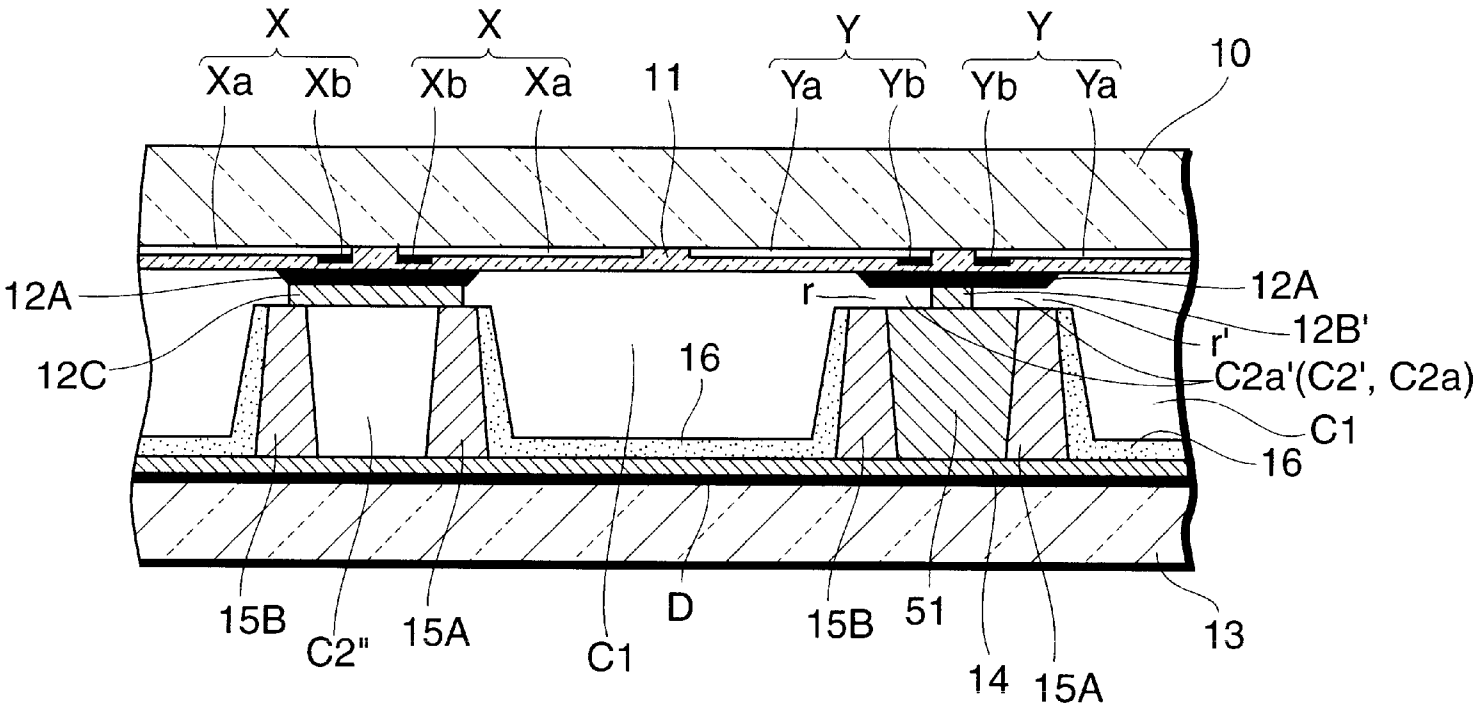
FIG. 17 is a schematic sectional view of an eighth embodiment according to the present invention.

FIG. 17 is a sectional view illustrating an eighth embodiment of PDP according to the present invention which is taken in the same position as that in FIG. 13 of the sixth embodiment.

The PDP in the sixth embodiment has the alternate arrangement of the row electrodes X and Y in the column direction in the manner X-Y, X-Y, . . . , whereas the PDP in the eighth embodiment has an arrangement in which the row electrodes X and Y of adjacent row electrode pairs (X, Y) in the column direction are changed in position in each display line such that two electrodes of the same kind are positioned back to back in the manner X-Y, Y-X, X-Y, . . . .

In the PDP of the eighth embodiment, an addressing discharge cell C2' is provided opposite the two bus electrodes Yb of the back-to-back row electrodes Y of adjacent row electrode pairs (X, Y), and is used in common between the two display discharge cells C1 positioned on both sides of the addressing discharge cell C2' in the column direction. The dielectric layer 51 is formed only in a first addressing discharge cell C2*a* facing the bus electrodes Yb of the respective row electrodes Y.

A second additional dielectric layer 12B' extends on the back surface of the first additional dielectric layer 12A in row direction (a direction perpendicular to FIG. 17) in a position opposite to an area between the two bus electrodes Yb of the back-to-back row electrodes Y of adjacent row electrode pairs (X, Y). The second additional dielectric layer 12B' has the back surface in contact with the dielectric layer 51, and divides a space between the first additional dielectric layer 12A and the dielectric layer 51 into two to form a pair of divided addressing discharge cells C2*a*' positioned back to back.

The left-hand one of the divided addressing discharge cell C2*a*' is connected through a clearance r, formed between the first additional dielectric layer 12A and the second transverse wall 15B, to a display discharge cell C1 adjacent thereto with the second transverse wall 15B between.

The right-hand one of the divided addressing discharge cell C2*a*' is connected through a clearance r', formed between the first additional dielectric layer 12A and the first transverse wall 15A, to a display discharge cell C1 adjacent thereto with the second transverse wall 15A between.

A cell C2" opposite to the two bus electrodes Xb of the respective row electrodes X arranged back to back is hollow. A third additional dielectric layer 12C is formed on an approximately overall back surface of the first additional dielectric layer 12A, and in contact with leading end faces of the first and second transverse walls 15A and 15B which are positioned on both sides of the cell C2", to block the cell C2" from the display discharge cells C1 adjacent thereto with the first transverse wall 15A and the second transverse wall 15B between.

The configuration of other components in the eighth embodiment is approximately the same as that of the PDP in the sixth embodiment, and therefore the same reference numerals are used.

In the PDP of the eighth embodiment, the addressing discharge is produced between the bus electrodes Yb and the column electrode D in the first addressing discharge cells C2*a*' which are divided by the second additional dielectric layer 12B' and positioned between the first additional dielectric layer 12A and the dielectric layer 51. Charged particles generated by the addressing discharge pass through the clearance r between the first additional dielectric layer 12A and the second transverse wall 15B and the clearance r' between the first additional dielectric layer 12A and the first transverse wall 15A, and flow into the corresponding display discharge cells C1 adjacent to the respective divided addressing discharge cells C2*a*'.

In this way, the PDP in the eighth embodiment has the arrangement of the row electrodes X positioned back to back and the row electrodes Y positioned back to back in the column direction. With this arrangement, when the discharge sustaining pulse is applied to the row electrode pair (X, Y) to initiate the sustaining discharge, discharge capacity is not formed in a non-display area between the row electrodes positioned back to back in the column direction, thus preventing a reactive power.

Figure 18:
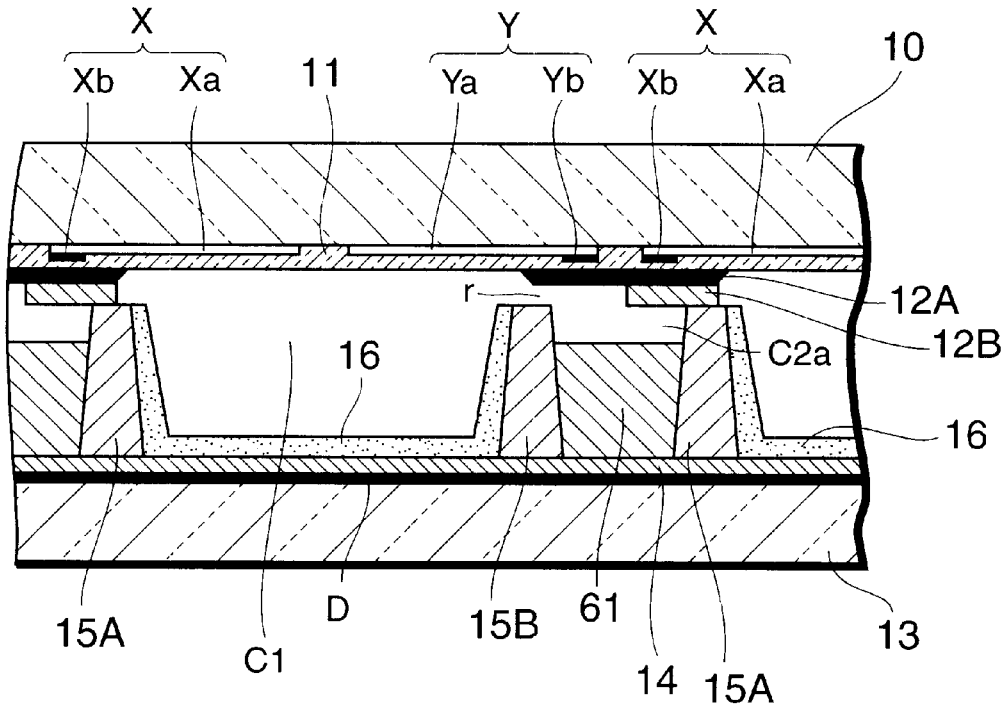
FIG. 18 is a schematic sectional view of a ninth embodiment according to the present invention.

FIG. 18 is a sectional view illustrating a ninth embodiment of PDP according to the present invention which is taken in the same position as that in FIG. 13 of the sixth embodiment.

Instead of the dielectric layer 51 made of the high $\epsilon$ materials in the sixth embodiment, the PDP in the ninth embodiment includes a conductor layer 61 which is formed of electrically-conductive materials such as silver or the like, and provided in each first addressing discharge cell C2*a* of the addressing discharge cell.

The configuration of other components in the ninth embodiment is approximately the same as that of the PDP in the sixth embodiment, and therefore the same reference numerals are used.

In the PDP of the ninth embodiment, the addressing discharge is also produced in the addressing discharge cell, formed separately from the display discharge cell C1 providing for the sustaining discharge, with the interposition of the electrically-conductive materials forming the conductor layer 61 in the first addressing discharge cell C2*a* of the addressing discharge cell. Accordingly, a discharge distance between the column electrode D and the bus electrode Yb is shortened to considerably decrease a starting voltage for the addressing discharge as compared with that in the prior art.

Figure 19:
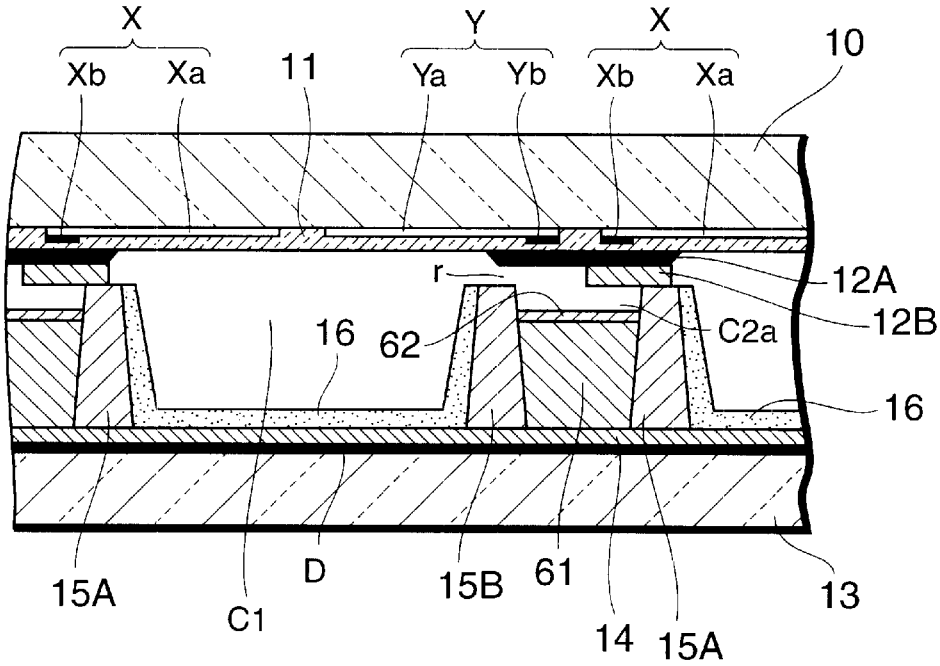
FIG. 19 is a schematic sectional view of a tenth embodiment according to the present invention.

FIG. 19 is a sectional view illustrating a tenth embodiment of PDP according to the present invention which is taken in the same position as that in FIG. 13 of the sixth embodiment.

The PDP in the tenth embodiment includes a dielectric layer 62 formed of the high $\epsilon$ materials and provided on a face, opposite to the first additional dielectric layer 12A, of the conductor layer 61 which is made of the electrically-conductive materials such as silver or the like and provided in each of the first addressing discharge cells C2*a* of the addressing discharge cells.

The configuration of other components in the tenth embodiment is approximately the same as that of the PDP in the sixth embodiment, and therefore the same reference numerals are used.

As in the case of the sixth embodiment, in the PDP of the tenth embodiment, the addressing discharge between the electrodes Yb and D is produced in the addressing discharge cell formed separately from the display discharge cell C1 providing for the sustaining discharge, with the interposition of the high $\epsilon$ materials forming the dielectric layer 62 and the electrically-conductive materials forming the conductor layer 61. Accordingly, a discharge distance between the column electrode D and the bus electrode Yb is shortened by the conductor layer 61, and also an apparent discharge distance between the column electrode D and the bus electrode Yb is more shortened by the dielectric layer 62, to considerably decrease a starting voltage for the addressing discharge as compared with that in the prior art.

Figure 20:
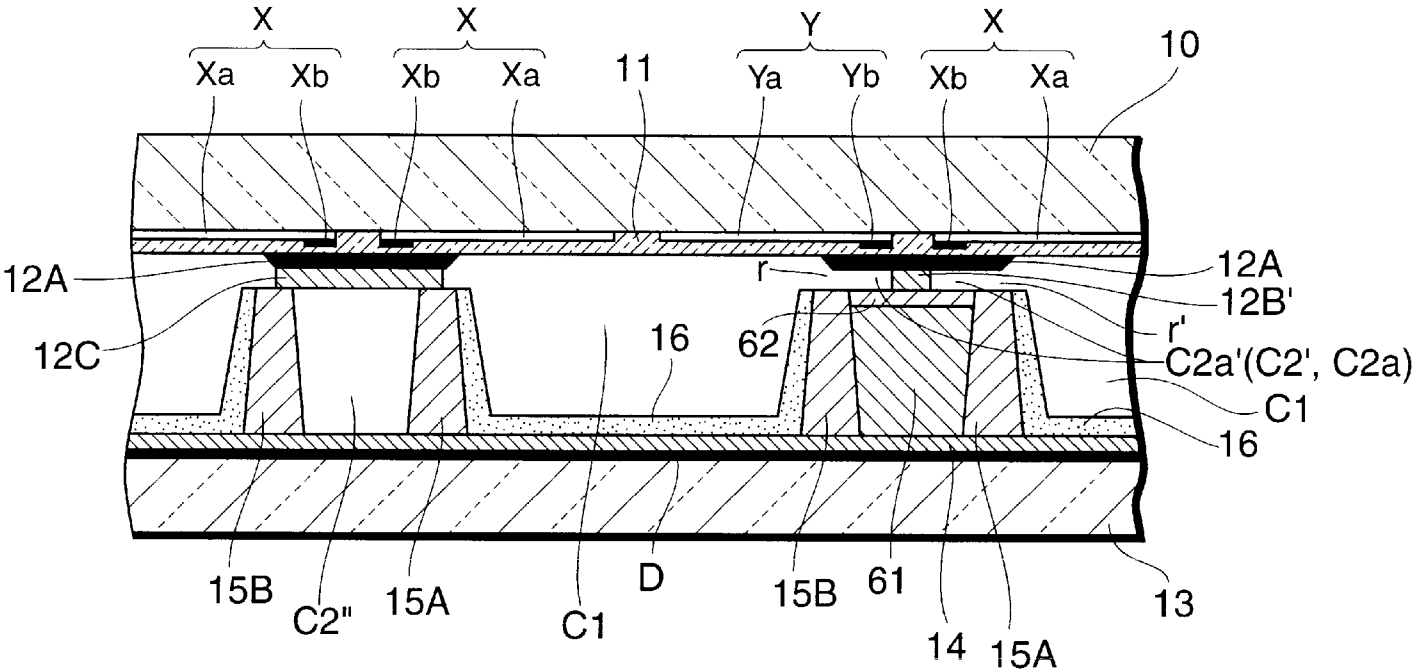
FIG. 20 is a schematic sectional view of an eleventh embodiment according to the present invention.

FIG. 20 is a sectional view illustrating an eleventh embodiment of PDP according to the present invention which is taken in the same position as that in FIG. 13 of the sixth embodiment.

As in the case of the PDP in the eighth embodiment, the PDP in the eleventh embodiment has an arrangement in which the row electrodes X and Y of adjacent row electrode pairs (X, Y) in the column direction are changed in position in each display line such that two electrodes of the same kind are positioned back to back in the manner X-Y, Y-X, X-Y, . . . .

As in the case of the PDP in the tenth embodiment, the conductor layer 61 made of the electrically-conductive materials and the dielectric layer 62 made of the high $\epsilon$ materials are provided in each of the first addressing discharge cells C2*a* of the addressing discharge cells C2'.

The configuration of other components in the eleventh embodiment is approximately the same as that of the PDP in the eighth embodiment, and therefore the same reference numerals are used.

As in the case of the PDP in the eighth embodiment, the PDP in the eleventh embodiment has the arrangement of the row electrodes X positioned back to back and the row electrodes Y positioned back to back in the column direction. This arrangement does not allow the PDP to have discharge capacity in the non-display area between the row electrodes positioned back to back in the column direction when the discharge sustaining pulse is applied to the row electrode pair (X, Y) to initiate the sustaining discharge, thus preventing a reactive power. Further, as in the case of the PDP in the tenth embodiment, the addressing discharge between the electrodes Yb and D is produced in the addressing discharge cell C2' formed separately from the display discharge cell C1 providing for the sustaining discharge, with the interposition of the high $\epsilon$ materials forming the dielectric layer 62 and the electrically-conductive materials forming the conductor layer 61. Accordingly, a discharge distance between the column electrode D and the bus electrode Yb is shortened by the conductor layer 61, and also an apparent discharge distance between the column electrode D and the bus electrode Yb is more shortened by the dielectric layer 62, to considerably decrease a starting voltage for the addressing discharge as compared with that in the prior art.

Figure 21:
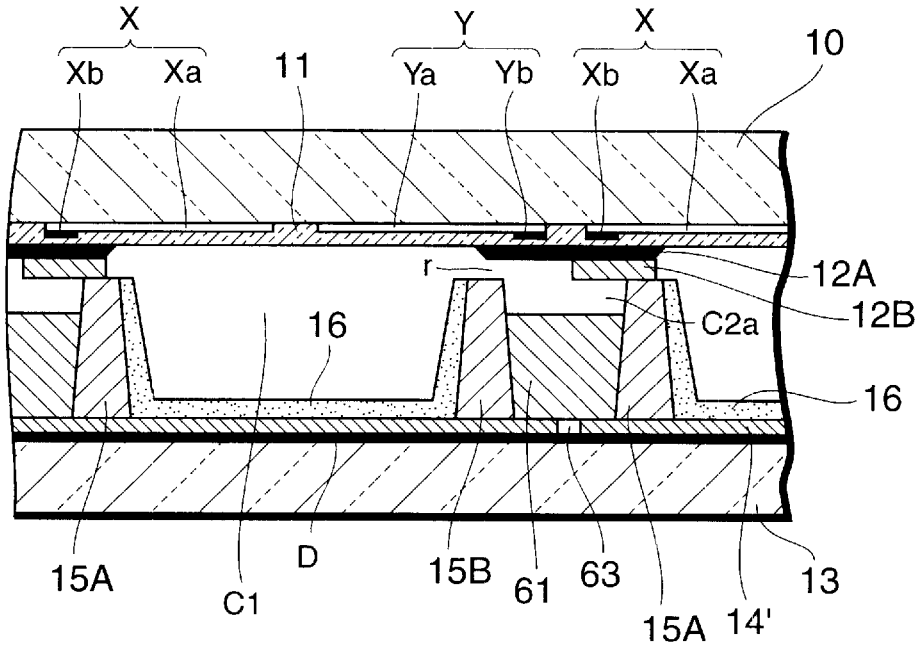
FIG. 21 is a schematic sectional view of a twelfth embodiment according to the present invention.

FIG. 21 is a sectional view illustrating a twelfth embodiment of PDP according to the present invention which is taken in the same position as that in FIG. 13 of the sixth embodiment.

The PDP of the ninth embodiment is configured such that the conductor layer 61 is electrically connected to the column electrode D with the interposition of the column electrode protective layer 14. In the PDP in the twelfth embodiment, the conductor layer 61 and the column electrode D are electrically connected through a through hole 63 provided in a column electrode protective layer 14', as illustrated in FIG. 21.

The configuration of other components in the twelfth embodiment is approximately the same as that in the PDP of the ninth embodiment, and therefore the same reference numerals are used.

With the PDP of the twelfth embodiment, due to the electric connection between the conductor layer 61 and the column electrode D with the interposition of the column electrode protective layer 14', a discharge distance between the column electrode D and each bus electrode Yb is further decreased, to considerably reduce a starting voltage for the addressing discharge as compared with that in the prior art.

Figure 22:
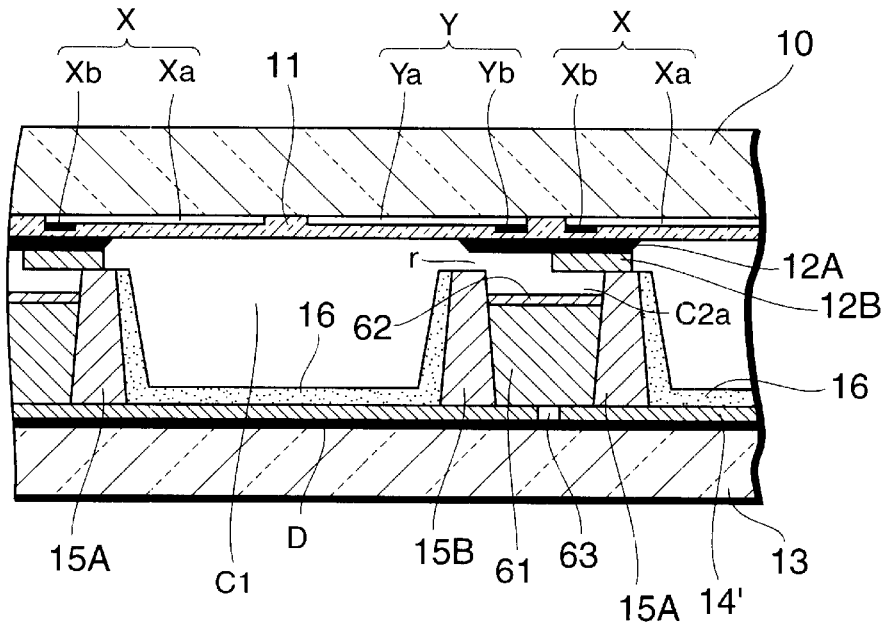
FIG. 22 is a schematic sectional view of a thirteenth embodiment according to the present invention.

FIG. 22 is a sectional view illustrating a thirteenth embodiment of PDP according to the present invention which is taken in the same position as that in FIG. 13 of the sixth embodiment.

The conductor layer 61 in the PDP of the tenth embodiment is electrically connected to the column electrode D with interposition of the column electrode protective layer 14. In the PDP in the thirteenth embodiment the conductor layer 61 and the column electrode D is electrically connected through a through hole 63 formed in a column electrode protective layer 14', as illustrated in FIG. 22.

The configuration of other components in the thirteenth embodiment is approximately the same as that in the PDP of the tenth embodiment, and therefore the same reference numerals are used.

With the PDP of the thirteenth embodiment, due to the electric connection between the conductor layer 61 and the column electrode D with the interposition of the column electrode protective layer 14', a discharge distance between the column electrode D and each bus electrode Yb is further decreased, to considerably reduce a starting voltage for the addressing discharge as compared with that in the prior art.

Figure 23:
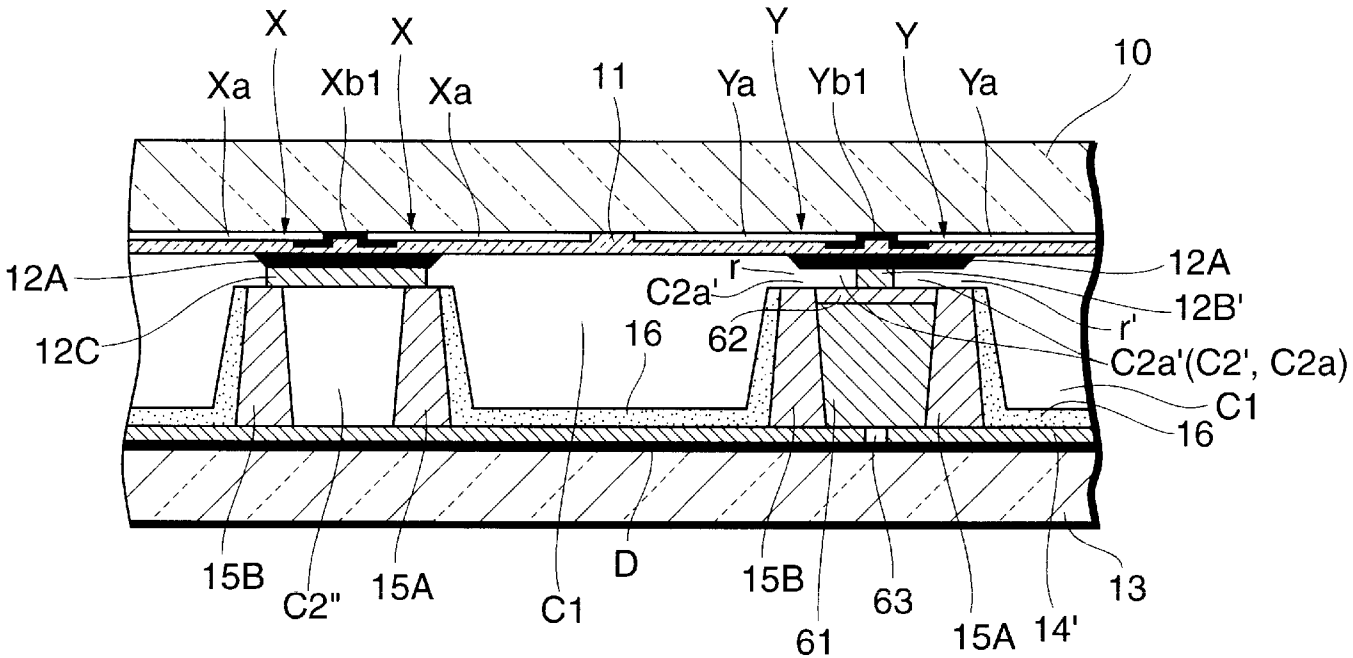
FIG. 23 is a schematic sectional view of a fourteenth embodiment according to the present invention.

FIG. 23 is a sectional view illustrating a fourteenth embodiment of PDP according to the present invention which is taken in the same position as that in FIG. 13 of the sixth embodiment.

The conductor layer 61 in the PDP of the eleventh embodiment is electrically connected to the column electrode D with the interposition of the column electrode protective layer 14. In the PDP in the fourteenth embodiment, the conductor layer 61 and the column electrode D are electrically connected through a through hole 63 formed in a column electrode protective layer 14', as illustrated in FIG. 23.

The PDP of the fourteenth embodiment further includes a bus electrode Xb1 used in common between the row electrodes X placed back to back, and a bus electrode Yb1 used in common between row electrodes Y placed back to back.

The configuration of other components in the fourteenth embodiment is approximately the same as that in the PDP of the eleventh embodiment, and therefore the same reference numerals are used.

With the PDP of the fourteenth embodiment, due to the electric connection between the conductor layer 61 and the column electrode D with the interposition of the column electrode protective layer 14', a discharge distance between the column electrode D and each bus electrode Yb1 is further decreased, to considerably reduce a starting voltage for the addressing discharge as compared with that in the prior art.

In each of the sixth to fourteenth embodiments, the first additional dielectric layer 12A serves as the black or dark light absorption layer in order to prevent the light generated by the addressing discharge in each addressing discharge cell C2 from leaking toward the display surface of the panel. Alternatively, instead of the use of the first additional dielectric layer 12A as the light absorption layer, each of the bus electrodes Xb, Yb may be designed to be a multi-layer construction including a black layer, and also a black or dark light absorption layer may be provided between the back-to-back bus electrodes in order to prevent the light generated by the addressing discharge in each addressing discharge cell C2 from leaking toward the display surface of the panel.

Figure 24:
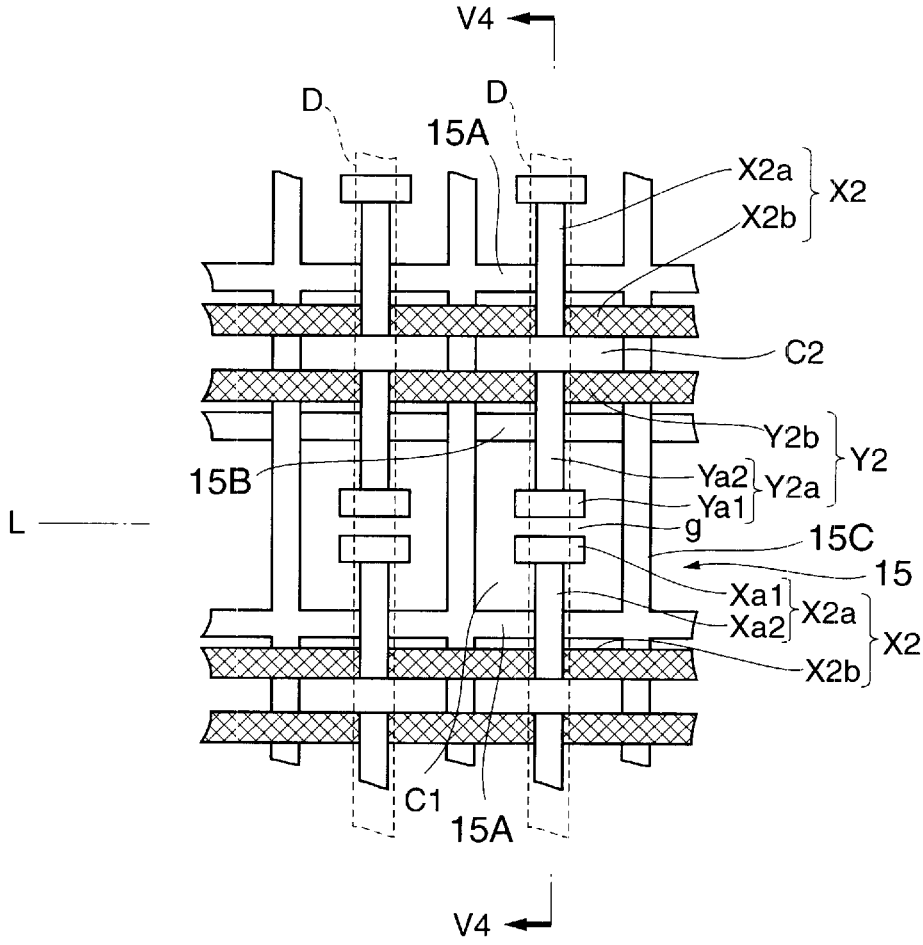
FIG. 24 is a schematic front view of a fifteenth embodiment according to the present invention.
Figure 25:
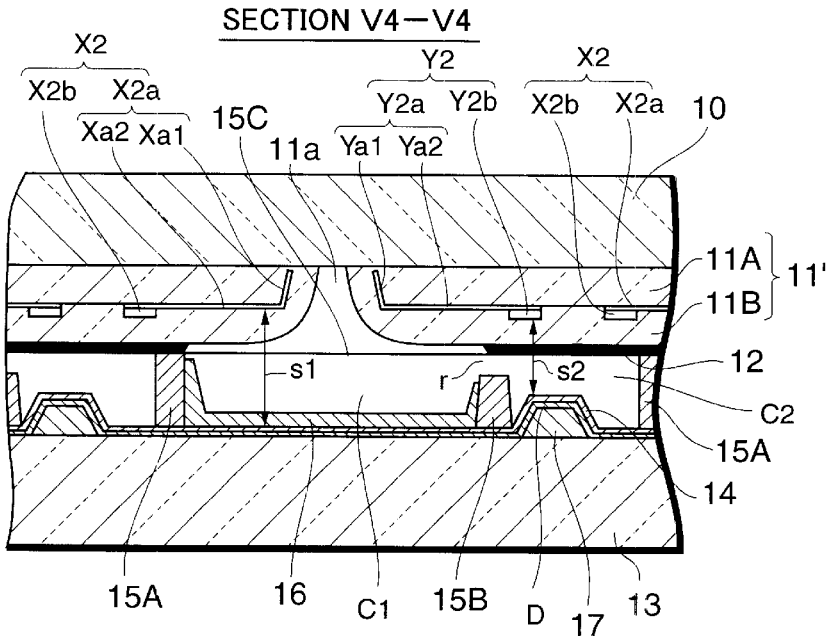
FIG. 25 is a sectional view taken along the V4—V4 line in FIG. 24.
Figure 26:
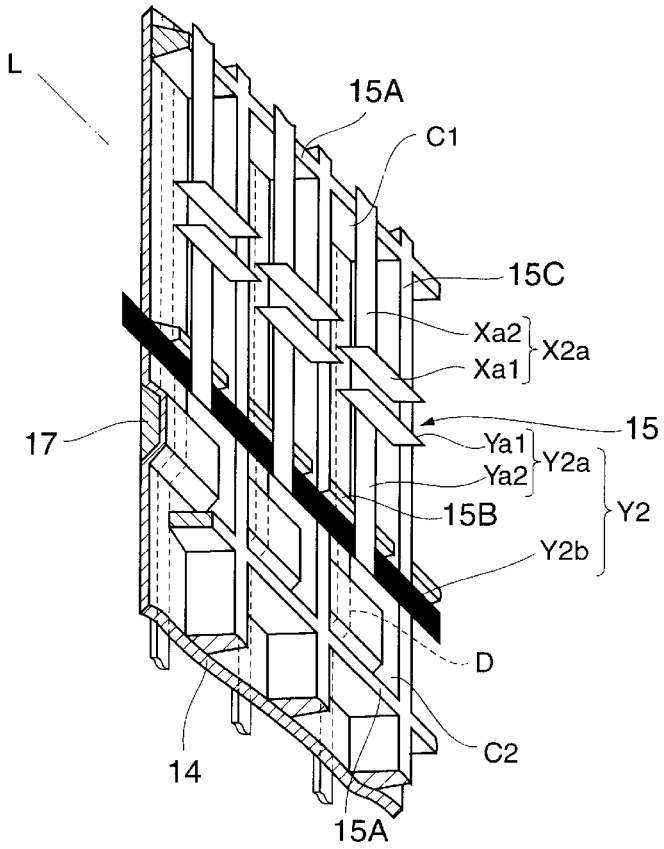
FIG. 26 is a perspective view in the fifteenth embodiment.

FIG. 24 to FIG. 26 are schematic views illustrating a fifteenth embodiment of PDP according to the present invention. FIG. 24 is a front view of part of the cell structure of the PDP in the fifteenth embodiment. FIG. 25 is a sectional view along the V4—V4 line in FIG. 24. FIG. 26 is a perspective view illustrating the fifteenth embodiment.

The configuration of a basic construction of the PDP in the FIGS. 24 to 26 is approximately the same as that in the first embodiment (FIGS. 1 to 3), and the components the same as or similar to those in the first embodiment are designated by the same reference numerals.

Each of row electrodes X2 of the PDP in the fifteenth embodiment is constructed by: transparent electrodes X2*a* each of which is formed of a transparent conductive film, made of ITO or the like, of a letter-T shape made up of a larger width leading end Xa1 and a smaller width base end Xa2, and extends in column direction in parallel to the front glass substrate 10; and a black bus electrode X2*b* which is formed of a metal film extending in the row direction of the front glass substrate 10 and connected to each of the smaller width base ends of the transparent electrodes X2*a*.

Likewise, each of row electrodes Y2 of the PDP is constructed by: transparent electrodes Y2*a* each of which is formed of a transparent conductive film, made of ITO or the like, of a letter-T shape made up of a larger width leading end Ya1 and a smaller width base end Ya2, and extends in column direction in parallel to the front glass substrate 10; and a black bus electrode Y2*b* which is formed of a metal film extending in the row direction of the front glass substrate 10 and connected to each of the smaller width base ends of the transparent electrodes Y2*a*.

The row electrodes X2 and Y2 are arranged in alternate positions in the column direction of the front glass substrate 10 (the vertical direction in FIG. 24, and the right-left direction in FIG. 25). The transparent electrodes X2*a* and Y2*a* are placed along the corresponding bus electrodes X2*b* and Y2*b* at regular intervals. A transparent electrode X2*a* extends in the direction of the partner transparent electrode Y2*a* and vice-versa so that the leading ends Xa1 and Ya1 of the respective transparent electrodes X2*a* and Y2*a* face each other with a discharge gap g having a required width between.

The leading ends Xa1, Ya1 of the respective transparent electrodes X2*a*, Y2*a* of the row electrodes X2, Y2 are bent in the direction of the front glass substrate 10 in relation to the respective base end Xa2, Ya2 extending in parallel to the front glass substrate 10, such that, as seen from FIG. 25, faces of the leading ends continued from the back surfaces of the respective base ends Xa2, Ya2 face each other approximately in parallel.

A recess 11*a* is provided in a dielectric layer 11' in a position between the mutually facing leading ends Xa1 and Ya1 of the transparent electrodes X2*b* and Y2*b*, and is interposed as an empty space between the leading ends Xa1 and Ya1 of the transparent electrodes X2*a* and Y2*a*.

Figure 35:
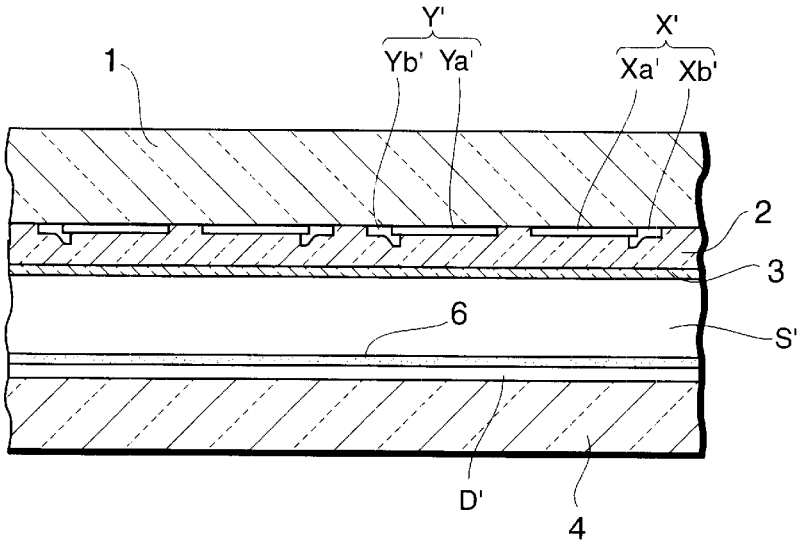
FIG. 35 is a sectional view taken along the V—V line in FIG. 34.
Figure 36:
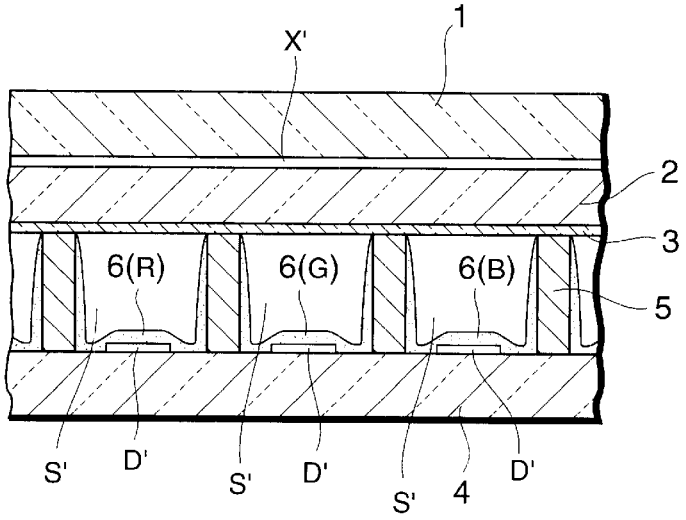
FIG. 36 is a sectional view taken along the W—W line in FIG. 34.

Images are generated in the PDP of the fifteenth embodiment as in the case in the PDP of the first embodiment. The transparent electrodes X2*a*, Y2*a* of the row electrodes X2, Y2 between which the sustaining discharge is produced do not follow the conventional pattern in which the leading ends of the electrodes are end-to-end with each other (see FIG. 35). The leading ends Xa1, Ya1 of the transparent electrodes X2*a*, Y2*a* are bent respectively in relation to the base ends Xa2, Ya2 to be face-to-face with each other approximately in parallel. The recess 11*a* is formed, in the dielectric layer 11', in a position between the mutually facing leading ends Xa1 and Ya1 of the transparent electrodes X2*a* and Y2*a*. The recess 11*a* has a function as an empty space to shorten a distance of an electric line force passing through the inside of the dielectric layer 11' when the sustaining discharge is caused, resulting in an increase in electric field strength of the electric line force as compared of that in the prior art.

Hence, the PDP is capable of initiating a sustaining discharge at low drive voltages even when a discharge gas has a high xenon-gas content for enhancement in the luminous efficiency.

In the PDP, the recess 11*a* may be formed independently in each display discharge cell C1, or in a band shape extending in the row direction.

The recess for allowing the surfaces of the respective transparent electrodes Xa and Ya of the row electrode pair (X1, Y1) to face each other and for providing an empty space between the transparent electrodes X2*a* and Y2*a* can be formed directly on the back surface of the front glass substrate 10.

Figure 27:
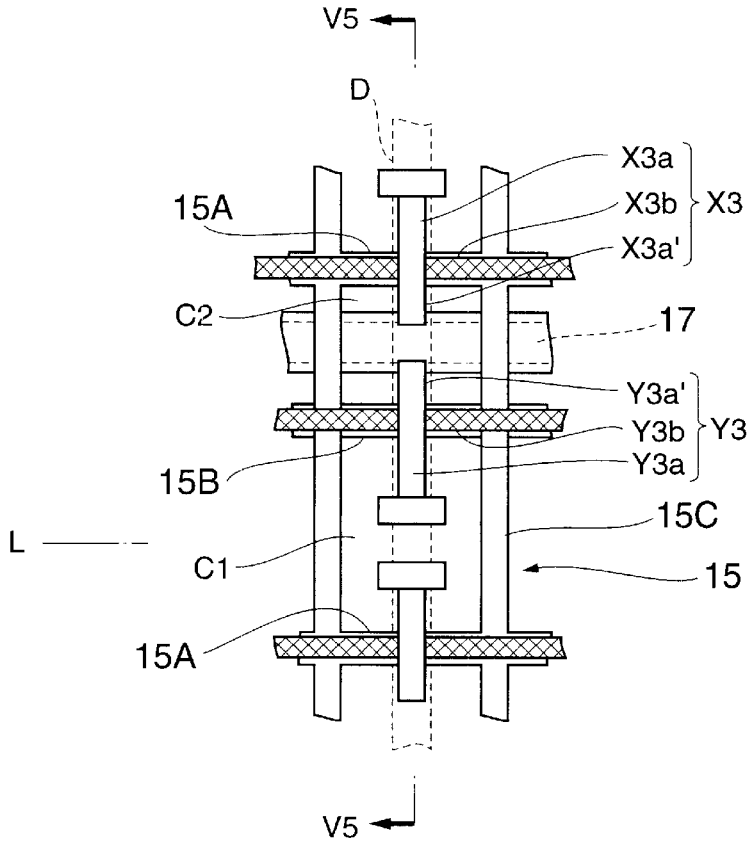
FIG. 27 is a schematic front view of a sixteenth embodiment according to the present invention.
Figure 28:
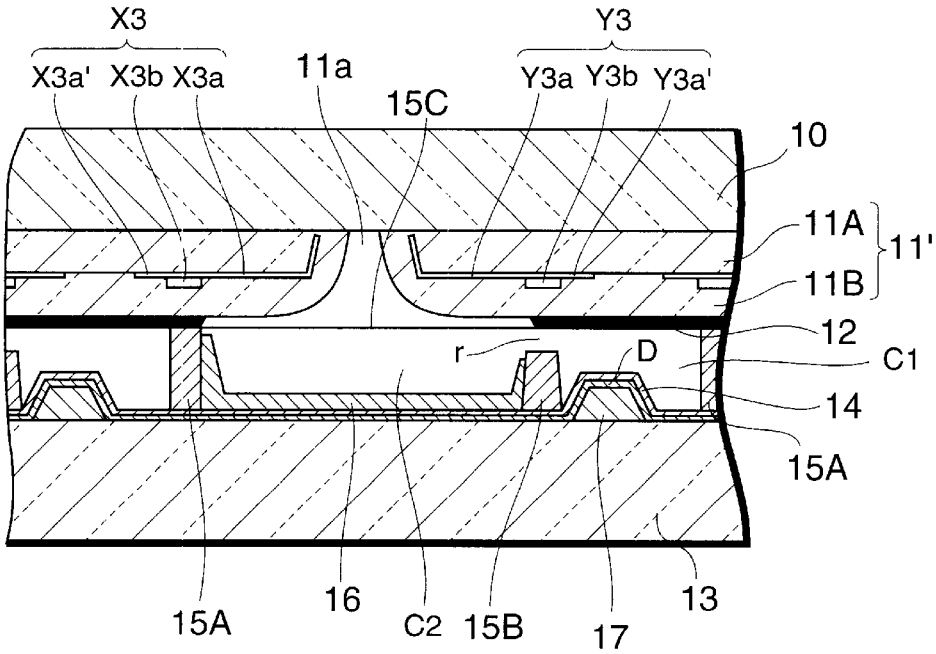
FIG. 28 is a sectional view taken along the V5—V5 line in FIG. 27.

FIG. 27 and FIG. 28 are schematic views illustrating a sixteenth embodiment of PDP according to the present invention. FIG. 27 is a partial front view of the cell structure of the PDP in the sixteenth embodiment. FIG. 28 is a sectional view along the V5—V5 line in FIG. 27.

The PDP in the sixteenth embodiment is configured such that a bus electrode X3*b* of a row electrode X3 is positioned opposite the first transverse wall 15A, and a base end X3*a*' of a transparent electrode X3*a* is connected to the bus electrode X3*b* and extends to a position opposite to the column electrode D, placed on the protrusion rib 17, with the addressing discharge cell C2 between.

Likewise, a bus electrode Y3*b* of a row electrode Y3 is positioned opposite to the second transverse wall 15B, and a base end Y3*a*' of a transparent electrode Y3*a* is connected to the bus electrode Y3*b* and extends to a position opposite to the column electrode D, placed on the protrusion rib 17, with the addressing discharge cell C2 between.

The configuration of other components in the sixteenth embodiment is approximately the same as that of the PDP in the fifteenth embodiment, and the same reference numerals are used.

The PDP in the fifteenth embodiment is configured such that the addressing discharge is produced between the bus electrode Y2*b* and the column electrode D placed on the protrusion rib 17 in each addressing discharge cell C2, whereas the PDP in the sixteenth embodiment is configured such that the addressing discharge is produced between the column electrode D placed on the protrusion rib 17 and the base end Y3*a*' of the transparent electrode Y3*a* extending from the bus electrode Y3*b* to the position opposite to the addressing discharge cell C2.

Other operations and advantages of the PDP are the same as those of the PDP in the fifteenth embodiment.

Figure 29:
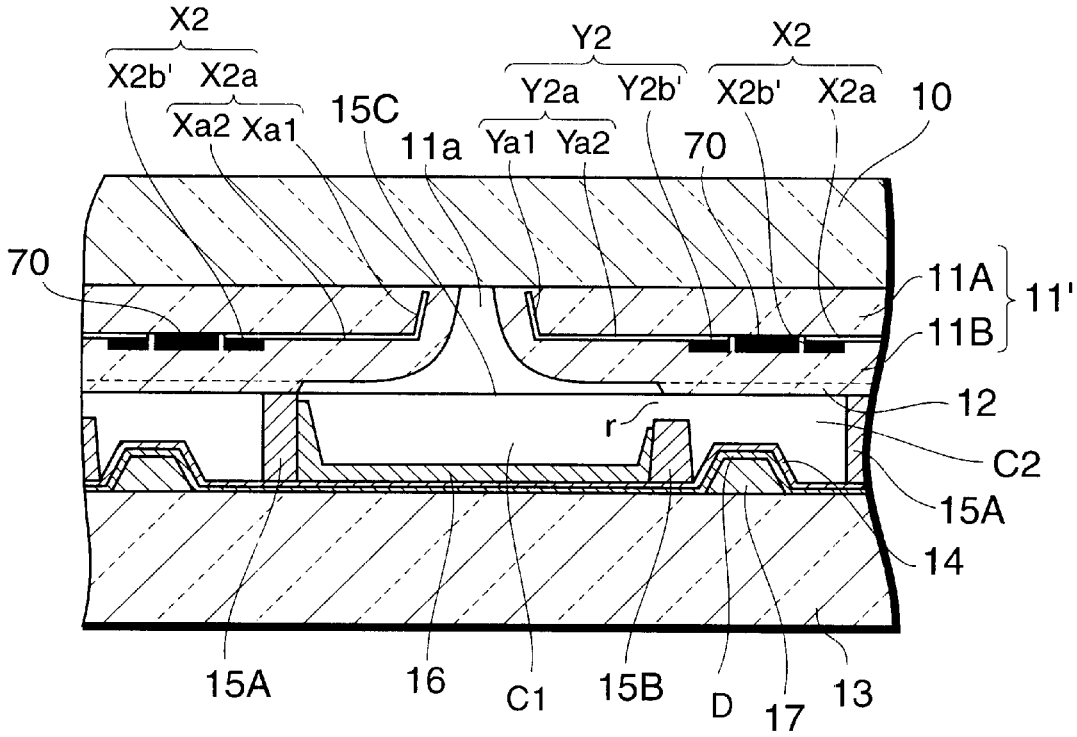
FIG. 29 is a schematic sectional view of a seventeenth embodiment according to the present invention.

FIG. 29 is a sectional view of a PDP according to a seventeenth embodiment of the present invention which is taken in the same position as that in FIG. 25.

In the PDP in the seventeenth embodiment, as in the case of the PDP in the fifteenth embodiment, bus electrodes X2*b*', Y2*b*' of the respective row electrodes X2, Y2 placed in a position opposite to the addressing discharge cell C2 each have a black conductive layer. Black or dark light absorption layers 70 respectively extend in the row direction between the back-to-back bus electrodes X2*b*' and Y2*b*', the back-to-back bus electrodes being positioned in adjacent display lines and facing the same addressing discharge cell C2. A face of the addressing discharge cell C2 facing toward the front glass substrate 10 is covered with the light absorption layer 70 and the black or dark conductive layers of the bus electrodes X2*b*' and Y2*b*'.

The configuration of other components in the seventeenth embodiment is approximately the same as that in the PDP of the fifteenth embodiment, and the same reference numerals are used.

With the PDP according to the seventeenth embodiment, the light generated in the addressing discharge cell C2 is blocked by the light absorption layer 70 and the black or dark conductive layers of the bus electrodes X2*b*' and Y2*b*' to be prevented from leaking toward the display surface of the front glass substrate 10. Further, the reflection of ambient light passing through the front glass substrate 10 onto an area corresponding to the addressing discharge cell C2 is prevented, thus enhancing the contrast in the display image.

Other operations and advantages are the same as those in the fifteenth embodiment.

Figure 30:
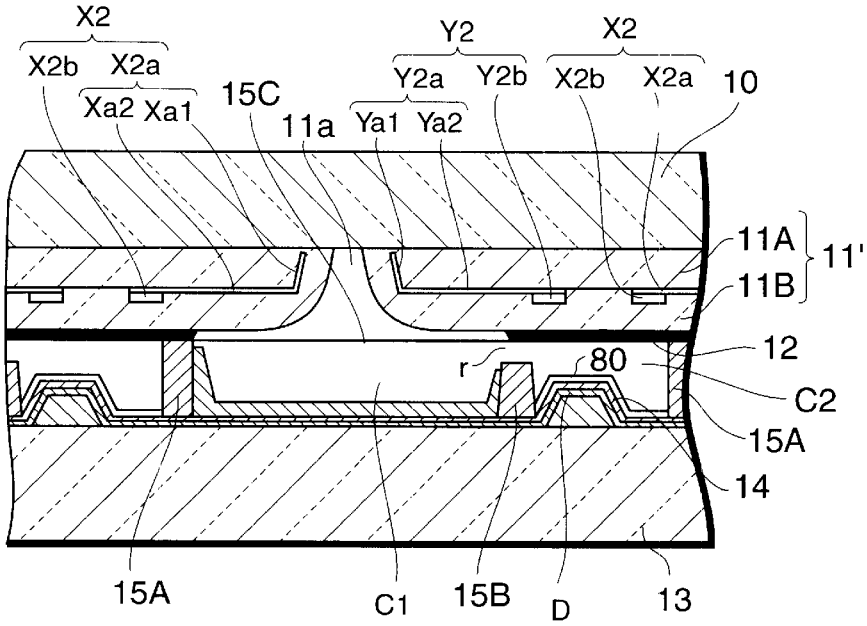
FIG. 30 is a schematic sectional view of an eighteenth embodiment according to the present invention.
Figure 31:
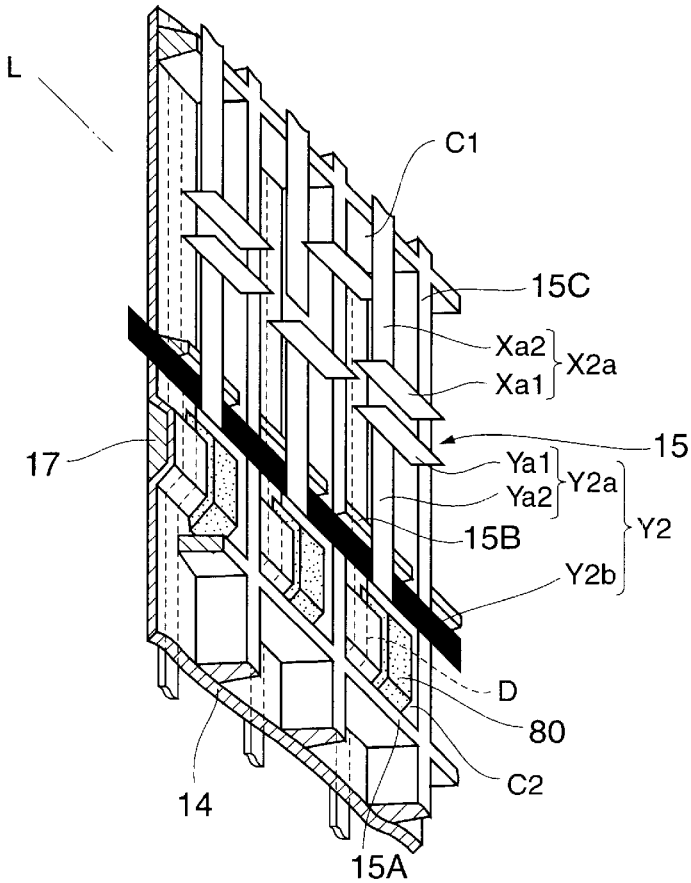
FIG. 31 is a perspective view in the eighteenth embodiment.

FIG. 30 and FIG. 31 are schematic views illustrating an eighteenth embodiment of a PDP according to the present invention. FIG. 30 is a sectional view of the PDP in the eighteenth embodiment which is taken in the same position as that in FIG. 25. FIG. 31 is a perspective view of the eighteenth embodiment.

The PDP in the eighteenth embodiment has a similar configuration to that of the PDP in the fifteenth embodiment, but a priming particle generating layer 80 is provided on parts of the column-electrode protective layer 14, first transverse wall 15A, second transverse wall 15B and vertical wall 15C which are not opposite to the column electrode D, in each addressing discharge cell C2.

The priming particle generating layer 80 is formed of ultraviolet-region light emissive materials having an afterglow characteristic in which, for example, the material is excited by ultraviolet rays having a predetermined wavelength or more, to continuously emit ultraviolet rays for 0.1 msec or more, preferably, for the length of the addressing period or more (e.g. 1.0 msec or more).

The priming particle generating layer 80 made of the ultraviolet region light emissive material may include a material having a lower work function (e.g. 4.2 eV or less), namely, a material having a higher coefficient of secondary electron emission (a high $\gamma$ material).

Examples of materials having a small work function and insulation properties include: oxides of alkali metals (e.g. $Cs_2O$: work function 2.3 eV); oxides of alkali-earth metals (e.g. CaO, SrO, BaO); fluorides (e.g. $CaF_2$, $MgF_2$); a material which crystal defects, impurities, or the like are caused in crystal to produce an imperfection level for an increase in a coefficient of secondary electron emission (e.g. MgOx having a composition ratio of Mg:O changed from 1:1 to cause crystal defects); $TiO_2$; $Y_2O_3$; and so on.

Another ultraviolet region light emissive materials have afterglow characteristics in which when the materials are excited by a 147 nm-wavelength vacuum ultraviolet rays radiated from xenon included in the discharge gas by a discharge, to continuously emit ultraviolet light for 0.1 msec or more, preferably, 1.0 msec or more (i.e. a time length of an addressing period or more). Examples of such ultraviolet region light emissive materials include $BaSi_2O_5:Pb^{2+}$ (a wavelength of emitted light: 350 nm), $SrB_4O_7F:Eu^{2+}$ (a wavelength of emitted light: 360 nm), $(Ba, Mg, Zn)_3Si_2O_7:Pb^{2+}$ (a wavelength of emitted light: 295 nm), $YF_3$:Gd, Pr, and so on.

The configuration of other components is the same as that in the fifteenth embodiment, and therefore the same reference numerals are used.

In the PDP of the eighteenth embodiment, the 147 nm-wavelength vacuum ultraviolet light is radiated from xenon included in the discharge gas by a reset discharge of a concurrent reset period in which wall charges are formed (or erased) in all the display discharge cells C1, and then excites the priming particle generating layer 80 provided in each addressing discharge cell C2 to allow it to emit ultraviolet rays. The ultraviolet rays excites the protective layer (MgO layer) overlying the additional dielectric layer 12 and the high $\gamma$ material of the priming particle generating layer 80 if the layer 80 includes it, to allow them to emit priming particles.

The priming particle generating layer 80 continuously emits the ultraviolet rays for at least 0.1 msec or more due to the afterglow characteristic of the ultraviolet-region light emissive materials forming the layer 80. Hence, during the addressing period following the concurrent reset period, a sufficient quantity of priming particles can be ensured in each addressing discharge cell C2 to cause an addressing discharge. Accordingly, the occurrence of a false discharge or a discharge time lag incident to a decrease in priming particle quantities with the passage of time after the completion of the reset discharge is prevented.

Other operations and advantages are the same as those in the fifteenth embodiment.

Figure 32:
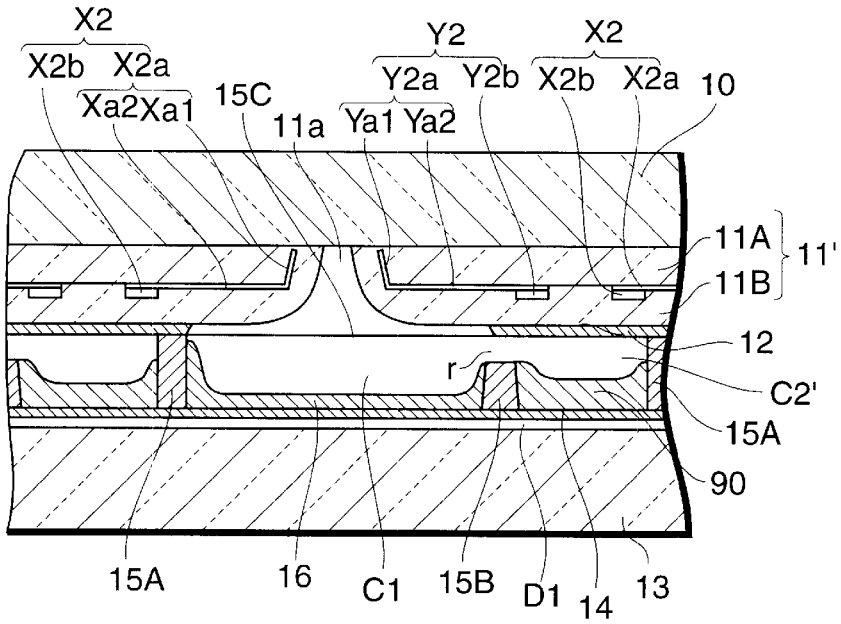
FIG. 32 is a schematic sectional view of a nineteenth embodiment according to the present invention.
Figure 33:
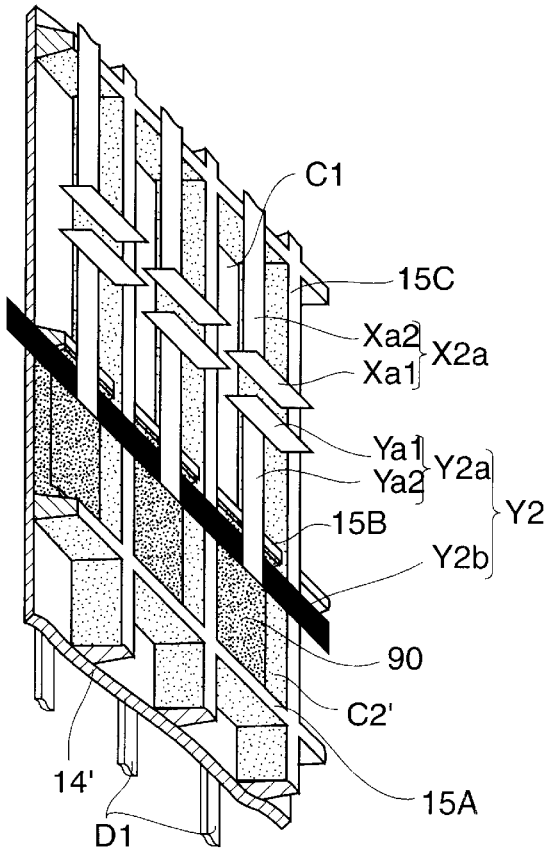
FIG. 33 is a perspective view in the nineteenth embodiment.
Figure 34:
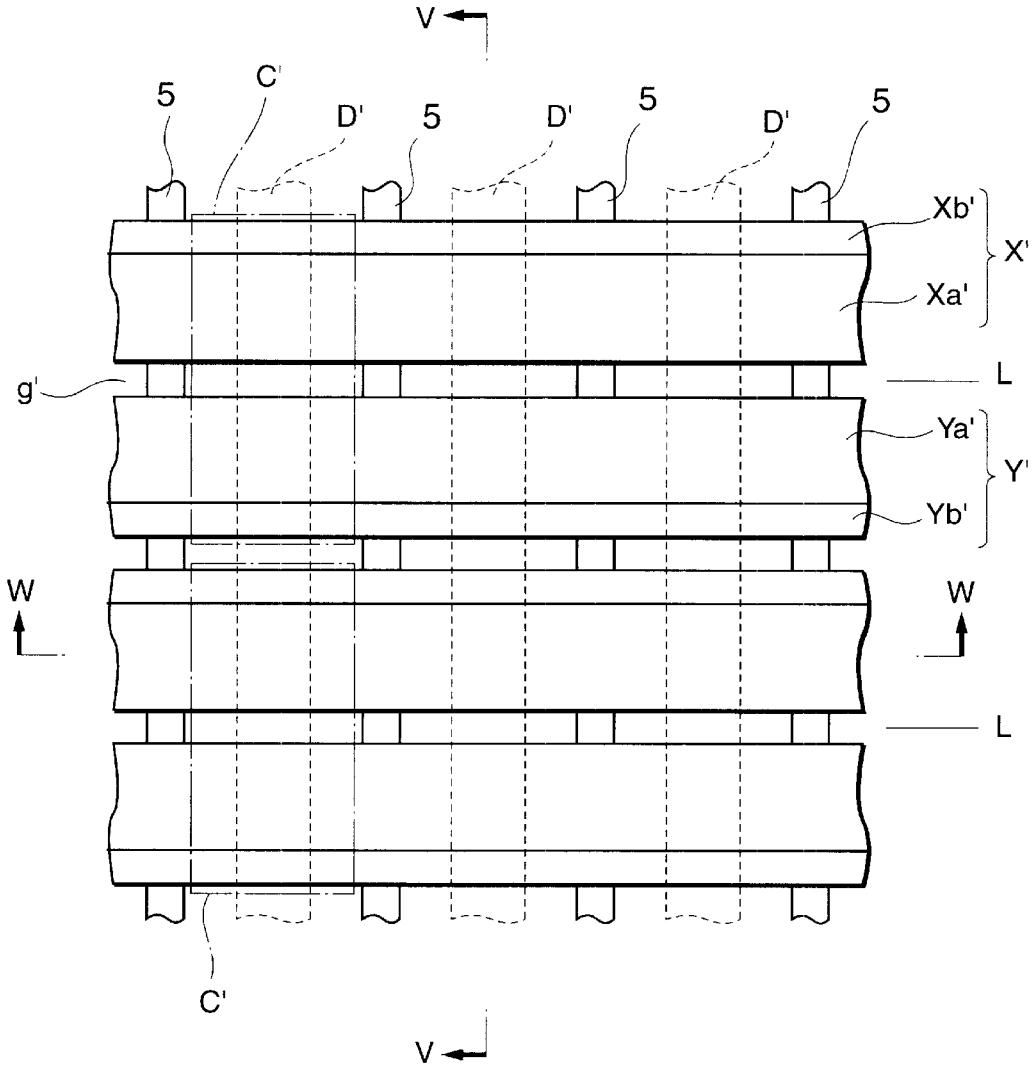
FIG.34 PRIOR ART
FIG. 34 is a schematic front view of a construction of a conventional PDP.

FIG. 32 and FIG. 33 are schematic views illustrating a nineteenth embodiment of the PDP according to the present invention. FIG. 32 is a sectional view of the PDP in the nineteenth embodiment which is taken at the same position as that in FIG. 25. FIG. 33 is a perspective view in the nineteenth embodiment.

The PDP in the nineteenth embodiment differs from the PDPs in the fifteenth to eighteenth embodiments in that the protrusion rib is not provided for bringing the column electrode closer to the bus electrode in each addressing discharge cell, and therefore a column electrode D1 is shaped in a straight line shape even in an area opposite to an addressing discharge cell C2'.

In the addressing discharge cell C2', a dielectric layer 90 made of high $\epsilon$ materials having 50 or more (50 to 250) of a relative permittivity $\epsilon$ is provided and reduces the discharge space in each addressing discharge cell C2' (a space-distance between the bus electrode Y2*b* and the dielectric layer 90).

Examples of the high $\epsilon$ materials for the dielectric layer 90 include $SrTiO_3$ and the like.

The configuration of other components in the nineteenth embodiment is approximately the same as that of the PDP in the fifteenth embodiment, and therefore the same reference numerals are used.

In the PDP of the nineteenth embodiment, the addressing discharge is produced between the electrodes D1 and Y2*b* with interposition of the high materials forming the dielectric layer 90 in each addressing discharge cell C2', and the high $\epsilon$ materials has 50 or more of a relative permittivity $\epsilon$. Hence, an apparent discharge-distance between the column electrode D1 and the bus electrode Y2*b* between which the addressing discharge is caused is shortened, resulting in a decreased starting voltage for the addressing discharge.

Other operations and advantages are the same as those in the fifteenth embodiment.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, including:

a front substrate;

a plurality of row electrode pairs arranged in a column direction on a back surface of the front substrate, and each extending in a row direction and forming a display line;

a dielectric layer covering the row electrode pairs on the back surface of the front substrate;

a back substrate placed opposite the front substrate with a discharge space interposed; and a plurality of column electrodes arranged in the row direction on a surface of the back substrate facing toward the front substrate, and each extending in the column direction to intersect the row electrode pairs and form unit light-emitting areas in the discharge space at the respective intersections, said plasma display panel comprising:

partition walls surrounding each of said unit light-emitting areas to define the unit light-emitting areas;

a dividing wall for dividing each of said unit light-emitting areas into a first discharge area facing mutually opposite parts of said respective row electrodes constituting each of the row electrode pairs and providing for a discharge produced between the mutually opposite row electrodes, and a second discharge area facing a part of one row electrode of said row electrodes initiating a discharge in association with the column electrode and providing for the discharge produced between the column electrode and the part of said one row electrode; and a communicating element provided between said first discharge area and said second discharge area for communication from the second discharge area to the first discharge area.

2. A plasma display panel according to claim 1, wherein each of said row electrodes constituting each of the row electrode pairs comprises an electrode body extending in the row direction, and transparent electrodes each protruding from the electrode body in the column direction in each unit light-emitting area to face the other one of the row electrodes constituting the row electrode pair with a discharge gap between, and wherein said electrode body of at least one of said row electrodes is opposite said second discharge areas to allow the discharge to be caused between the electrode body and the column electrode in each second discharge area.

3. A plasma display panel according to claim 1, wherein each of said row electrodes constituting each of the row electrode pairs comprises an electrode body extending in the row direction, and transparent electrodes each protruding from the electrode body in the column direction in each unit light-emitting area to face the other one of the row electrodes constituting the row electrode pair with a discharge gap between, and each having an extended part extending from the electrode body in the direction opposite to the transparent electrode of said the other one of the row electrodes, and wherein said extended part of the transparent electrode of at least one of said row electrodes is opposite said second discharge area to allow the discharge to be caused between the extended part of the transparent electrode and the column electrode in the second discharge area.

4. A plasma display panel according to claim 1, further comprising an additional element jutting out from a part of said dielectric layer opposite each of said second discharge areas, in a direction of the second discharge area, and coming in contact with said partition walls defining the corresponding unit light-emitting area, to block the second discharge area from the unit light-emitting area adjacent thereto but not associated therewith.

5. A plasma display panel according to claim 1, further comprising a black or dark-colored light absorption layer provided on an area opposite each of said second discharge areas on the front substrate side.

6. A plasma display panel according to claim 5, wherein each of said row electrodes constituting each of the row electrode pairs comprises an electrode body extending in the row direction, and transparent electrodes each protruding from the electrode body in the column direction in each unit light-emitting area to face the other one of the row electrodes constituting the row electrode pair with a discharge gap between, wherein said electrode body of at least one of said row electrodes is opposite said second discharge area to allow the discharge to be caused between the electrode body and the column electrode in the second discharge area, and wherein said light absorption layer is constituted by a black or dark-colored layer included in said electrode body of the row electrode, and a black or dark-colored layer formed in an area opposite to said second discharge area on the front substrate side.

7. A plasma display panel according to claim 5, further comprising an additional element jutting out from a part of said dielectric layer opposite each of said second discharge areas in a direction of the second discharge area, to come in contact with said partition walls defining the corresponding unit light-emitting area, to block the second discharge area from the unit light-emitting area adjacent thereto but not associated therewith, and formed of a black or dark-colored material to constitute said light absorption layer.

8. A plasma display panel according to claim 1, further comprising a phosphor layer provided only in said first discharge area for emitting light by means of the discharge.

9. A plasma display panel according to claim 1, further comprising a protrusion element provided in an area opposite to said second discharge area on the back substrate side and between the back substrate and the column electrode, and protruding into the second discharge area in the direction of the front substrate, to allow a part of said column electrode opposite each of said second discharge electrodes to jut out in the direction of the front substrate.

10. A plasma display panel according to claim 1, further comprising a priming particle generating layer provided in each of said second discharge areas of said unit light-emitting areas.

11. A plasma display panel according to claim 10, wherein said priming particle generating layer is formed of a ultraviolet-region light emissive material having an afterglow characteristic of continuously radiating ultraviolet rays when the material is excited by ultraviolet rays having a predetermined wavelength.

12. A plasma display panel according to claim 11, wherein said ultraviolet-region light emissive material has an afterglow characteristic for 0.1 msec or more.

13. A plasma display panel according to claim 11, wherein said ultraviolet-region light emissive material has an afterglow characteristic for 1 msec or more.

14. A plasma display panel according to claim 11, wherein said priming particle generating layer includes a material having a work function of 4.2 eV or less.

15. A plasma display panel according to claim 1, further comprising a dielectric layer, formed of a material having a relative permittivity of 50 or more, provided in a position in each of said second discharge areas on the back substrate side in a form of being interposed between said column electrode and the part of said one row electrode initiating the discharge in association with the column electrode.

16. A plasma display panel according to claim 1, wherein said communicating element is constituted by a clearance formed between the front substrate and said dividing wall by determining a height of the dividing wall dividing off said first discharge area and said second discharge area in each unit light-emitting area to be less than a height of said partition walls for defining the periphery of the unit light-emitting area.

17. A plasma display panel according to claim 1, wherein said communicating element is constituted by a groove formed in said dividing wall dividing off said first discharge area and said second discharge area, and having both ends opening toward the first discharge area and the second discharge area.

18. A plasma display panel according to claim 1, further comprising an additional element jutting out from a part of said dielectric layer opposite each of said second discharge areas in a direction of the second discharge area, to come in contact with said partition walls defining each of the unit light-emitting areas, to block the second discharge area from the unconnected unit light-emitting area adjacent thereto, wherein said communicating element is formed in the additional element.

19. A plasma display panel according to claim 1, further comprising either a high relative permittivity dielectric layer formed of a material having a required relative permittivity, or a conductor layer formed of an electrically-conductive material, provided on the back substrate in each of said second discharge areas.

20. A plasma display panel according to claim 19, wherein said material forming said high relative permittivity dielectric layer has a relative permittivity of 50 or more.

21. A plasma display panel according to claim 19, wherein said second discharge area is further divided into a first area positioned between said column electrode and said part of the one row electrode initiating the discharge in associated with the column electrode, and a second area having the area of the second discharge area with the exception of the first area, and either said high relative permittivity dielectric layer or said conductor layer is formed in said first area of said second discharge area.

22. A plasma display panel according to claim 21, further comprising a priming particle generating layer provided in said second area of each of said second discharge areas.

23. A plasma display panel according to claim 22, wherein said priming particle generating layer is formed of a ultraviolet-region light emissive material having an afterglow characteristic of continuously radiating ultraviolet rays when the material is excited by ultraviolet rays having a predetermined wavelength.

24. A plasma display panel according to claim 23, wherein said ultraviolet-region light emissive material has an afterglow characteristic for 0.1 msec or more.

25. A plasma display panel according to claim 23, wherein said ultraviolet-region light emissive material has an afterglow characteristic for 1 msec or more.

26. A plasma display panel according to claim 22, wherein said priming particle generating layer includes a material having a work function of 4.2 eV or less.

27. A plasma display panel according to claim 19, further comprising a high relative permittivity dielectric layer provided on a face, facing the front substrate, of said conductor layer formed in each of said second discharge areas.

28. A plasma display panel according to claim 19, wherein said conductor layer is formed on a column-electrode protective layer covering said column electrodes, and is electrically connected to the column electrode through a conducting element with the interposition of the column-electrode protective layer.

29. A plasma display panel according to claim 28, wherein said conducting element electrically connecting said conductor layer to said column electrode is a through hole formed in the column-electrode protective layer.

30. A plasma display panel according to claim 19, wherein said one row electrodes and said the other row electrodes constituting the row electrode pairs are arranged in alternate positions in each display line in the column direction such that the one row electrodes of the adjacent row electrode pairs are arranged back to back, and the other row electrodes of the adjacent row electrode pairs are arranged back to back, wherein either said high relative permittivity dielectric layer or said conductor layer is formed in said second discharge area opposite to said parts of said back-to-back one row electrodes individually initiating the discharge in association with the column electrode, and wherein a space formed between either said high relative permittivity dielectric layer or said conductor layer and the dielectric layer covering the row electrode pairs, is divided by a rib member extending in the row direction into areas respectively facing said parts of said one row electrodes arranged back to back.

31. A plasma display panel according to claim 1, wherein parts of said row electrodes, constituting each of the row electrode pairs, for causing the discharge therebetween, are opposite each other with an empty space between.

32. A plasma display panel according to claim 31, wherein said empty space is constituted by a recess formed in a part of said dielectric layer positioned between said parts of the row electrodes initiating the discharge therebetween.

33. A plasma display panel according to claim 32, wherein said recess is formed in an island-like form in each of said first discharge areas.

34. A plasma display panel according to claim 32, wherein said recess is formed in a band shape extending in the row direction and continuing between said first discharge areas adjacent to each other in the row direction.

35. A plasma display panel according to claim 31, wherein said parts of said row electrodes constituting each of the row electrode pairs for initiating the discharge therebetween are opposite each other in a face-to-face form.

36. A plasma display panel according to claim 31, wherein each of said row electrodes constituting each of the row electrode pairs comprises an electrode body extending in the row direction, and transparent electrodes each protruding from the electrode body in the column direction in each unit light-emitting areas to face the other one of the row electrodes constituting the row electrode pair with a discharge gap between, and wherein said electrode body of at least one of said row electrodes is opposite said second discharge area to allow the discharge to be caused between the electrode body and the column electrode in each second discharge area.

37. A plasma display panel according to claim 31, wherein each of said row electrodes constituting each of the row electrode pairs comprises an electrode body extending in the row direction, and transparent electrodes each protruding from the electrode body in the column direction in each unit light-emitting areas to face the other one of the row electrodes constituting the row electrode pair with a discharge gap between, and each having an extended part extending from the electrode body in the direction opposite to the transparent electrode of said the other one of the row electrodes constituting the row electrode pair, and wherein said extended part of the transparent electrode of at least one of said row electrodes is opposite said second discharge area to allow the discharge to be caused between the extended part of the transparent electrode and the column electrode in each second discharge area.

* * * * *